US005965210A

United States Patent [19]

Tada et al.

[11] Patent Number: 5,965,210

[45] Date of Patent: Oct. 12, 1999

[54] HOT DIP COATING APPARATUS AND METHOD

[75] Inventors: Masahiko Tada; Chiaki Kato; Toshitane Matsukawa, all of Chiba; Kazumasa Mihara; Kenichi Unoki, both of Hiroshima, all of Japan

[73] Assignees: Kawasaki Steel Corporation, Hyogo; Mitsubishi Heavy Industries, Ltd., Tokyo, both of Japan

[21] Appl. No.: 08/997,608

[22] Filed: Dec. 23, 1997

[30] Foreign Application Priority Data

| | | | |
|---|---|---|---|
| Dec. 27, 1996 | [JP] | Japan | 8-349695 |
| Dec. 27, 1996 | [JP] | Japan | 8-349696 |
| Dec. 27, 1996 | [JP] | Japan | 8-349697 |
| Dec. 27, 1996 | [JP] | Japan | 8-349698 |
| Dec. 27, 1996 | [JP] | Japan | 8-349699 |

[51] Int. Cl.[6] ..... B05D 1/18

[52] U.S. Cl. ..... 427/434.7; 427/598; 427/431; 427/434.5; 427/443.2; 118/405

[58] Field of Search ..... 427/598, 431, 427/433, 443.2, 436, 434.7, 434.5; 118/405

[56] References Cited

U.S. PATENT DOCUMENTS

| | | | |
|---|---|---|---|
| 4,169,426 | 10/1979 | Kornmann et al. | 118/67 |
| 5,665,437 | 9/1997 | Frommann et al. | 427/591 |
| 5,702,528 | 12/1997 | Paramonov et al. | 118/623 |
| 5,827,576 | 10/1998 | Carter et al. | 427/436 |

FOREIGN PATENT DOCUMENTS

| | | |
|---|---|---|
| 8-333661 | 12/1996 | European Pat. Off. . |
| 43 44 939 | 2/1995 | Germany . |
| 60-089556 | 5/1985 | Japan . |
| 63-192853 | 8/1988 | Japan . |
| 3-079747 | 4/1991 | Japan . |
| WO 93/18198 | 9/1993 | WIPO . |
| 9603533 | 2/1996 | WIPO . |
| WO 96/02683 | 2/1996 | WIPO . |

*Primary Examiner*—Shrive Beck
*Assistant Examiner*—Michael Barr
*Attorney, Agent, or Firm*—Young & Thompson

[57] ABSTRACT

A hot dip coating apparatus and method, enables stable and continuous production of a coated steel strip having a high degree of uniformity of the coating quality over the breadth of the steel strip and clean coated surfaces free of deposition of dross. The hot dip coating apparatus has a bottom slit through which a steel strip to be coated is introduced and pulled upward through the coating tank, and an electromagnetic sealing device which applies a magnetic field to the molten metal in the coating tank so as to hold the molten metal inside the tank. The coating tank is provided at its top with an overflow dam for allowing the molten metal to overflow out of the coating tank. The apparatus also has a molten metal supply system which produces a circulating flow of the molten metal through the coating tank. The molten metal supply system has molten metal buffers which communicate with a molten metal supply passage and from which the molten metal is discharged towards the steel strip.

9 Claims, 9 Drawing Sheets

(f-1)

(f-2)

HOT DIP COATING APPARATUS AND METHOD

BACKGROUND OF THE INVENTION

1. Field of the Invention

The present invention relates to a hot dip coating apparatus, as well as a method, for coating a steel sheet by using a coating bath of a molten metal. More particularly, the present invention is concerned with a hot dip coating apparatus and method in which a steel sheet is introduced into a bath of a molten metal through a slit formed in the bottom of a tank holding such a bath and pulled upward through the molten metal, while the bath of the molten metal is held without leaking through the slit by the effect of magnetic fields applied thereto.

2. Description of the Related Art

Hot-dip-coated steel sheets coated with various kinds of metals such as Zn, Al, Pb and Sn are finding diversified use, such as materials of automotive panels, architectural members, household electric appliances, cans, and so forth. A general description will be given of a process for producing a galvanized steel sheet, i.e., steel sheet coated with Zn, which is a typical example of the hot-dip-coated steel sheets. A cold rolled steel sheet is subjected to a pre-treatment in which the surfaces of the steel sheet are cleaned. The steel sheet is then heated and annealed in a non-oxidizing or reducing atmosphere, followed by cooling down to a temperature suitable for the hot dip coating, without allowing the steel sheet to be oxidized in the course of the cooling. The continuous steel sheet thus cooled is dipped in a bath of molten zinc. The steel sheet is then guided by rollers immersed in the molten zinc, e.g., sink rolls, so as to be pulled vertically upward out of the bath of the molten zinc. Any surplus molten zinc deposited on the surfaces of the steel sheet is removed by a doctoring device, such as a gas wiper, so that a suitable amount of the coating zinc remains on the surfaces of the steel sheet, which is then cooled.

This known method suffers from several problems caused by the presence of the immersed devices in the bath. First, the size of the tank containing the bath of molten zinc is inevitably large because of the presence of the immersed devices. The use of such immersed devices also restricts the selection and change of the type of coating molten metal. In addition, maintenance of the immersed devices is difficult. Furthermore, flaws or defects may appear in the surfaces of the product coated steel sheet due to introduction of dross into the nip of the sink rolls through which the steel sheet runs.

Accordingly, methods have been proposed for hot dip coating without the use of immersed devices, such as sink rolls. Among such proposed methods is "air pot method" that is capable of coating both sides of the steel sheet. As shown in FIG. 7, this method employs an apparatus which includes a coating tank for holding the molten metal bath and that has a slit in its bottom. A steel strip is introduced into the tank through the slit by being pulled vertically upward, so as to be coated with the metal of the bath. The coating apparatus further has an RF magnetic field application device 2*b* and a movable magnetic field application device, arranged as shown in FIG. 7, and further includes molten metal drain passage 11, molten metal supply passage 12, slit nozzle 20 and guide roller 33.

One of the critical requisites for the air pot method is a high degree of uniformity of the coating layer in the breadthwise direction of the strip. It is also important to ensure that there is no leakage of the molten metal through the clearance between the edges of the bottom slit and the surfaces of the strip running through the slit. Various measures have been proposed to meet these requirements by making use of an electromagnetic force. For instance, Japanese Patent Laid-Open No. 7-258811 proposes an apparatus in which a horizontal magnetic field is applied to the molten metal so as to hold the bath of the molten metal, while Japanese Patent Laid-Open No. 63-310949 discloses a method in which a bath of a molten metal is held by means of a linear motor. A method disclosed in Japanese Patent Laid-Open No. 5-86446 holds a bath of a molten metal by the combined effect of electromagnetic forces produced by an RF magnetic field and a movable magnetic field. In the method proposed in Japanese Patent Laid-Open No. 63-303045, molten metal constituting a bath is held by the effect of an interaction between a magnetic field and electric current and, at the same time, a gas jet seals the clearance at the slit through which the strip is introduced.

All these methods employ electromagnetic forces for the purpose of holding the molten metal without allowing the molten metal to leak through the clearances between the steel strip and the bottom slit through which the strip is steadily introduced and pulled upward. Such methods, however, have the following problems. The molten metal and the steel strip are induction-heated by electric currents induced therein as an effect of application of the electromagnetic fields, so that the temperatures of the molten metal and the steel strip are elevated undesirably. Such a temperature rise is notable particularly at the edges of the steel strip. The rise of the temperatures affects the reaction between the molten metal of the bath and the steel sheet in the bath, such that an alloy layer rapidly grows at the interface between the steel strip and the molten metal. The alloy is hard and fragile, so that an excessive growth of the alloy layer reduces the adhesion between the coating layer and the steel strip, permitting easy separation of the coating layer from the steel strip.

One commonly adopted technique to avoid this problem is to circulate the molten metal in the coating tank to prevent abnormal growth of the alloy layer caused by the rise of temperature of the molten metal or the steel strip. Such a circulation uses the molten metal as a cooling medium to prevent local build up of heat in the molten metal or the steel strip.

The molten metal is commonly circulated by continuously supplying the molten metal into the tank while discharging the same from the tank, as disclosed in Japanese Patent Laid-Open Nos. 5-86446 and 8-337875. However, continuous supply and discharge of the molten metal into and from the coating tank causes a variation of the flow velocity of the molten metal across the breadth of the steel strip, with the result that the dynamic pressure is locally elevated along the breadth of the steel strip. Leakage of the molten metal tends to take place where the dynamic pressure is high.

Circulation of the molten metal poses another problem in that separation of the coating layer is likely to occur due to the extraordinary growth of the alloy layer caused by lack of uniformity of the composition of the molten metal. The molten metal supplied into the coating tank inevitably contains components that suppress growth of the hard and fragile alloy layer at the interface between the coating molten metal and the steel strip. For instance, molten zinc used as the molten metal contains Al as the component for suppressing growth of the alloy layer. A variation of the flow velocity of the molten metal along the breadth of the steel sheet causes a corresponding variation in the effect of the alloy suppressing component along the breadth of the steel sheet, with the result that the growth of alloy layer cannot be suppressed satisfactorily where the flow velocity of the molten metal is comparatively low.

In most cases, the supply of molten metal into the coating tank is performed by a pump. Direct supply of the molten metal into the tank, however, creates a variation in the flow velocity of the molten metal in the breadthwise direction of the steel strip, particularly where the molten metal delivered by the pump is received. The above-described problems remain unresolved.

Japanese Patent Laid-Open No. 8-337858 discloses a hot dip coating technique in which molten metal is drained from a coating tank by overflow. This technique can provide a uniform distribution of flow velocity of the molten metal at the drained region where the molten metal is drained outside the coating tank, because the molten metal is allowed to overflow without encountering any obstacle. This technique therefore can effectively be used as a measure for suppressing local rapid growth of alloy layer, but is still unsatisfactory in that it cannot effectively suppress variation of the flow velocity of the molten metal where the molten metal is supplied into the coating tank. In other words, there is a demand for a technique that provides uniform flow velocity distribution of the molten metal in the breadthwise direction of the steel strip where the molten metal is supplied and where it is discharged.

The method in which a steel strip is introduced into a bath of molten metal through a bottom slit of a coating tank and pulled upward while the bath is held inside the tank by the action of electromagnetic force also faces the problem that, since the volume of the molten metal in the bath is extremely small, deposition of dross inside the tank becomes notable, particularly when the flow velocity of the molten metal varies along the breadth of the steel strip, tending to allow deposition of the dross on the steel strip.

The air pot coating method also suffers from the following problem. Vibration or other forms of spatial displacements may occur during steady coating operations causing the steel strip to fail to pass through the bottom slit of the tank cleanly, with resultant breakage of the edges of the slit or of the tank wall due to collision with the steel strip. Replacement or repair of damaged parts may be difficult and expensive.

One of solutions to this problem is to control the position of the coating tank in accordance with the position of path of the steel sheet so as to ensure that the steel strip always runs through the center of the slit formed in the bottom of the coating tank. This solution, however, is uneconomical because it is expensive. In addition, movement of the coating tank during the coating operation causes a vibration of the molten metal which renders the electromagnetic force temporarily ineffective, causing leakage of the molten metal through the slit. Leaking molten metal falls onto various components arranged along the pass line of the steel strip which is perpendicular to and right below the slit, such as deflector rollers of a steel sheet supporting device, support rollers for levelling the steel strip, guide rollers for suppressing vibration and so forth, so as to attach to these components. The coating metal attached to the path line components causes defects in the steel strip. Frequent cleaning, replacement or other maintenance work is required to prevent this problem.

Thus, some extraordinary conditions, such as extreme winding or vibration of the steel strip, hamper a stable and smooth coating operation. In order to deal with this problem, specific means for dealing with these extraordinary conditions are desired.

The methods that use electromagnetic forces to hold the bath of molten metal also suffer from a problem in that the molten metal tends to leak through the slit formed in the bottom of the coating tank during transitory periods, such as the period immediately after the start of supply of the molten metal into the coating tank or the period when the molten metal is drained after the coating operation is finished, because the effect of the electromagnetic force is insufficient to restrain the molten metal during the transitory period. Such leakage ceases when the electromagnetic force becomes large enough to hold the molten metal. However, the leakage of the molten metal through the slit before the electromagnetic force is large enough to hold the molten metal causes the same problems as described above in connection with the extraordinary conditions.

SUMMARY OF THE INVENTION

The present inventors, through an intense study aimed at obviating the above-described problems, have discovered that it is critical and important for the method that relies upon electromagnetic force to hold the molten metal that the molten metal is circulated during the operation in such a manner as to maintain a uniform breadthwise distribution of flow velocity of the molten metal along the breadth of the steel strip. At the same time, it is highly desirable that the following requirements are satisfied:

(1) Suppress or substantially eliminate leakage of molten metal without damaging the coating tank or the edges of the slit, even under extraordinary conditions, such as extreme winding or vibration of the steel sheet during the coating operation.

(2) Suppress or substantially eliminate leakage of the molten metal in a transitory period, such as immediately after the start of supply of the molten metal or the period after the finish of the supply of the molten metal.

The present invention is based upon the above-described discovery and knowledge.

Thus, it is a primary object of the present invention to provide a hot dip coating apparatus, as well as a hot dip coating method, which enables stable and continuous production of a hot-dip-coated steel strip having a high degree of uniformity of coating quality over the breadth of the steel strip and that is free of deposition of dross, while preventing damage to the coating system that require suspension of operation for repair and maintenance.

As stated before, the inventors have found that, in the method in which a steel strip is introduced through a bottom slit and pulled upward while a electromagnetic force is applied to hold the molten metal, there is a very critical requirement that the molten metal flows through the coating tank during the steady operation in such a manner as to maintain a uniform breadthwise distribution of flow velocity of the molten metal along the breadth of the steel strip. With this knowledge, the present inventors have found that the above-described requirement can successfully be met by an arrangement wherein a buffer is provided at the molten-metal supply side so as to reduce any breadthwise variation of flow velocity of the molten metal in the supply region, while an overflow dam is provided at the drain side so that the molten metal can freely overflow the dam and freely fall therefrom, thus suppressing breadthwise variation of the flow velocity of the molten metal in the drain region of the-coating tank.

According to one aspect of the present invention, there is provided a hot dip coating apparatus, comprising: a coating tank provided at its bottom with a bottom slit for enabling a steel strip to upwardly run therethrough into the coating tank so that the steel strip is coated as the steel strip is pulled upward; an electromagnetic sealing device including a pair of magnetic field applying means at both sides of the steel strip opposing each other at a predetermined spacing to apply a magnetic field to molten metal inside the coating tank thereby holding the molten metal within the coating tank; an overflow dam provided on the coating tank so that the molten metal overflows the overflow dam to be drained from the coating tank; a molten metal supplying system associated with the coating tank and including an auxiliary tank for melting the coating metal and holding the molten metal therein, a molten metal supply passage through which the molten metal is supplied from the auxiliary tank to the coating tank, and a molten metal drain passage through which the molten metal drained from the coating tank is returned to the auxiliary tank; and buffers arranged within or in the vicinity of the coating tank in communication with the molten metal supply passage, so as to direct the flow of the molten metal towards the steel strip.

Preferably, the coating tank is divided into a plurality of tank sections, and moving means associated with each the tank section are provided so as to move the tank section towards and away from the steel strip.

It is also preferred that a molten metal discharge passage communicating with each buffer is provided for discharging the molten metal towards the steel strip. The molten metal discharge passage preferably has a slit-shaped outlet extending in the breadthwise direction of the steel strip.

It is also preferred that heating means are provided to heat the molten metal in the molten metal supply passage.

It is also preferred that dross removing means are arranged within or in the vicinity of the auxiliary tank.

The hot dip coating apparatus may further comprise moving means arranged on both sides of the steel strip and associated with the respective magnetic field applying means of the electromagnetic sealing device, so as to move the associated magnetic field applying means towards and away from the steel strip.

The hot dip coating apparatus preferably further comprises a steel strip profile measuring device arranged upstream of the bottom slit as viewed in the direction of running of the steel strip, and a profile judging device for judging any abnormal profile of the steel strip based on a signal derived from the steel strip profile measuring device.

It is also preferred that a pair of sealing members for preventing leakage of the molten metal are provided immediately below the bottom slit opposing the steel strip and so as to be brought into and out of contact with the steel strip.

It is also preferred that a pair of gas-jet sealing devices for preventing leakage of the molten metal are provided immediately below the bottom slit opposing the steel strip.

Preferably, the hot dip coating apparatus comprises both types of sealing means for preventing downward leakage of the molten metal, the pair of sealing members being arranged immediately below the bottom slit opposing the steel strip and so as to be brought into and out of contact with the steel strip, and the pair of gas-jet sealing devices being arranged immediately below the sealing members opposing to the steel strip.

Preferably, each of the sealing members includes a heat-resistant belt supported by rotatable rollers. More preferably, at least one of the rollers is power-driven.

The hot dip coating apparatus preferably has further sealing members arranged immediately above the bottom slit and made of a material meltable at a temperature not higher than the melting temperature of the coating metal.

It is also preferred that the hot dip coating apparatus further has a steel strip supporting device for guiding the steel strip into the coating tank through the bottom slit, the steel strip supporting device including a deflector roller which deflects the pre-treated steel strip so as to run vertically upward, support rollers disposed downstream of the deflector roller, for correcting any warp of the steel strip, a pair of guide rollers disposed downstream of the support rollers and below the bottom slit of the coating tank, for suppressing vibration of the steel strip, and a molten metal scraping device associated with each of the guide rollers for scraping molten metal off the guide roller.

In accordance with another aspect of the present invention, there is provided a hot dip coating method for coating a steel strip, in which the steel strip is introduced into a coating tank through a bottom slit in the bottom of the coating tank and pulled upward to run through the coating tank, and in which a molten metal is supplied from an auxiliary tank to a lower portion of the coating tank through a molten metal supply passage and drained from an upper portion of the coating tank to the auxiliary tank through a molten metal drain passage to be circulated through the coating tank, the molten metal being held in the coating tank by a magnetic field applied thereto by means of a plurality of magnetic field applying means arranged at both sides of the steel strip at a predetermined spacing from each other, so that the steel strip is coated with the molten metal while it runs upward through the coating tank, the method comprising: allowing the molten metal to overflow the upper end of the coating tank to be drained from the coating tank; and supplying the molten metal into the coating tank through a buffer provided in communication with the molten metal supply passage, such that the molten metal is discharged through the buffer towards the steel strip.

In carrying out this method, it is preferred that the coating tank has a split structure composed of a plurality of tank sections and that each the tank section and the associated magnetic field applying means are arranged for movement towards and away from the steel strip. In such a case, the method has the steps of: conducting on-line measurement of the profile of the steel strip at a location upstream of the bottom slit of the coating tank; stopping the supply of the molten metal when the value measured in the on-line measurement has exceeded a predetermined limit value; draining the molten metal from the coating tank after stopping the supply of the molten metal; and moving, after the draining of the molten metal, the tank sections away from the steel strip together with or without the magnetic field applying means.

Preferably, the hot dip coating method comprises: providing in the coating tank a molten metal discharge passage in communication with the buffer; and causing the molten metal to be discharged from the molten metal discharge passage towards the steel strip.

Preferably, the rate of circulation of the molten metal between the coating tank and the auxiliary tank is 100 liter/min. or greater.

It is also preferred that the temperature of the molten metal in the molten metal supply passage is controlled to be not lower than the temperature of the molten metal in the auxiliary tank.

It is preferred that the coating operation is started through the steps of: causing the steel strip to run at a predetermined velocity without starting the supply of the molten metal into the coating tank, while moving a pair of sealing members into contact with or to positions in the close proximity of the steel strip at a location immediately below the bottom slit of the coating tank and/or blowing a gas onto the steel strip at the location; applying a magnetic field to the coating tank; and commencing the supply of the molten metal into the coating tank, thereby starting the coating operation.

It is also preferred that the coating operation is terminated through the steps of: stopping the supply of the molten metal into the coating tank, while moving a pair of sealing members into contact with or to positions in the close proximity of the steel strip at a location immediately below the bottom slit of the coating tank and/or blowing a gas onto the steel strip at the location; evacuating the coating tank by causing the molten metal remaining in the coating tank to attach to and be conveyed by the running steel strip or by shifting the molten metal into an auxiliary tank; and ceasing the application of the magnetic field, thereby terminating the coating operation.

The coating operation also may be started through the steps of: disposing, at a location within or immediately above the bottom slit of the coating tank, sealing members made of a material meltable at a temperature not higher than the melting temperature of the coating metal, so as to block the bottom slit of the coating tank, while the supply of the molten metal into the coating tank has not yet commenced; causing the steel strip to run through the bottom slit, past the sealing members; commencing the supply of the molten metal into the coating tank; and commencing application of the magnetic field to the coating tank, thereby starting the coating operation.

These and other objects, features and advantages of the present invention will become clear from the following description of the preferred embodiments when the same is read in conjunction with the accompanying drawings.

DESCRIPTION OF THE PREFERRED EMBODIMENTS

DESCRIPTION OF THE PREFERRED EMBODIMENTS

First of all, a general description will be given of the hot dip coating apparatus in accordance with the present invention.

Figure 1:
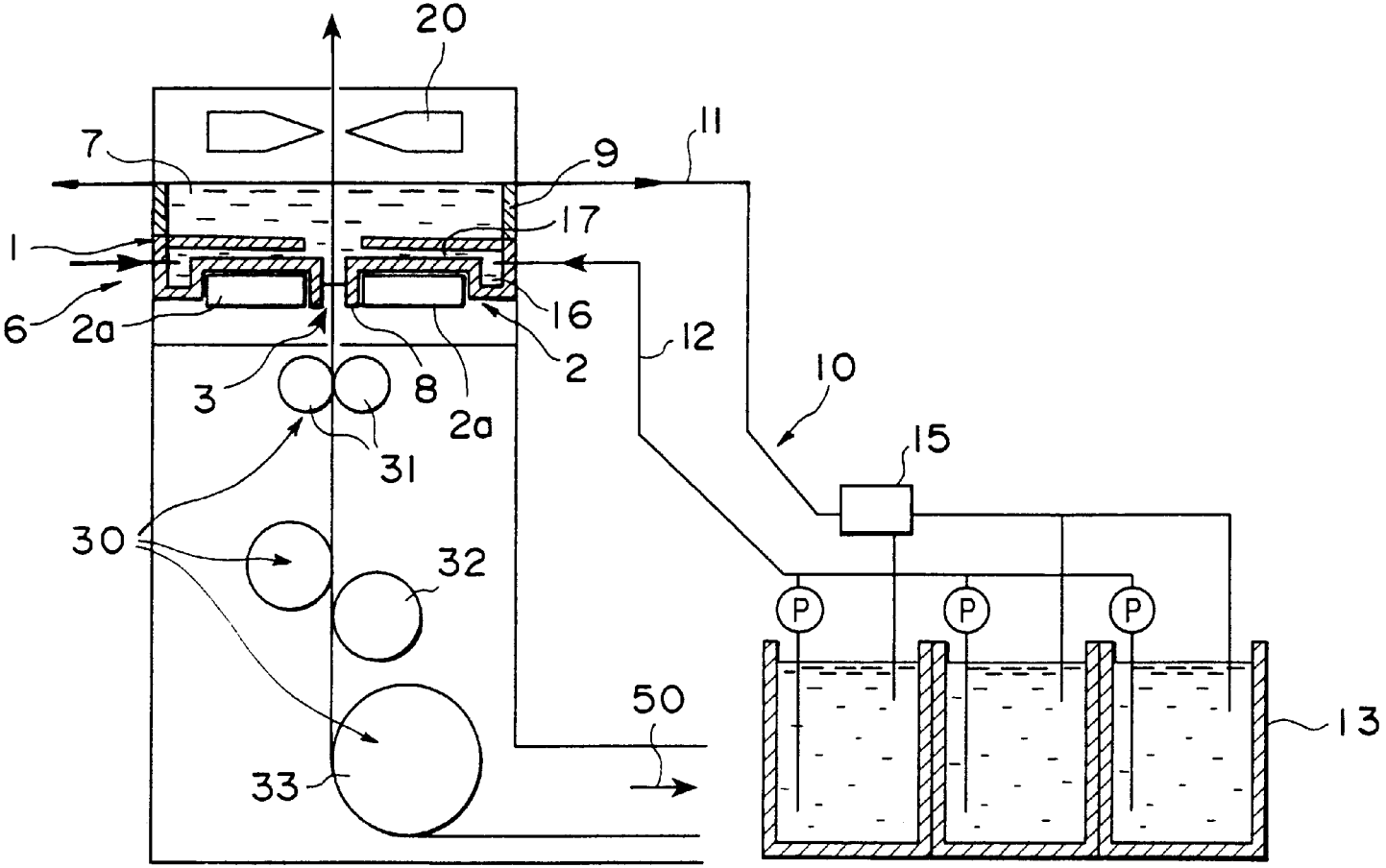
FIG. 1 is a schematic sectional view of a first embodiment of the hot dip coating apparatus in accordance with the present invention.

Referring to FIG. 1, a hot dip coating apparatus embodying the present invention, generally denoted by 6, includes a coating tank 1 which is provided in its bottom with a slit 3, and an electromagnetic sealing device 2 which generates electromagnetic force to hold a molten metal that is a coating bath inside the tank 1.

Although not required, the coating tank 1 may have a downwardly projected portion 8 which projects downward from the body of the tank in parallel with the pass line of a steel strip. The slit 3 is formed in the bottom of projected portion 8, so that steel strip S passes through slit 3 substantially at the center of projected portion 8. The slit 3 may have a variety of forms provided that the steel sheet to be coated can smoothly pass therethrough. The size of the clearance defined by opposing longitudinal edges of slit 3 depends on various factors, including the configuration of steel strip S to be coated. In order to minimize the leakage of the molten metal, the size of the clearance defined by the opposing longitudinal edges of slit 3 is made as small as possible, but it generally ranges from 10 to 50 mm. Thus, a horizontal section of projected portion 8 provides an elongated rectangular passage hole having two longitudinal sides extending in the direction of a breadth of the steel sheet to be coated. The molten metal is supplied from an auxiliary tank 13 to both sides of steel strip S running past the slit in projected portion 8, through a molten metal supply passage 12. Steel strip S is upwardly introduced into coating tank 1 from the lower side thereof through slit 3 so as to run into the bath of the molten metal along projected portion 8.

The term "molten metal" used in this specification means a melt of a metal with which steel strip S is to be coated. No restriction is imposed on the composition of the metal of the melt, although it is generally Zn, Al, Pb, Sn or an alloy of such metals.

The term "steel strip" is used to mean a sheet or strip of a steel produced through a rolling process, and may be used, for example, as an automotive, household electric appliance or architectural material. Thus, there is no restriction in regard to the composition and the size of steel strip S.

As seen from FIG. 1, coating tank 1 used in the coating apparatus of the present-invention has an overflow dam 9 on the upper end thereof so that the molten metal is drained to the exterior of coating tank 1 by flowing over dam 9. More specifically, dam 9 is situated on the side walls of coating tank 1. Dam 9 ensures that the molten metal is drained from coating tank 1 while exhibiting uniform distribution of flow velocity along the breadth of steel strip S. Thus, in the hot dip coating method of the present invention, the molten metal is drained naturally without encountering any resistance and without requiring any sucking means such as a pump. Consequently, troublesome work, such as maintenance which otherwise would be necessary for such sucking means, is eliminated. Moreover, the lack of such a sucking means further provides a uniform distribution of the flow velocity over the breadth of steel strip S, because a sucking means, such as a pump, creates a non-uniform breadthwise distribution of the flow velocity around steel strip S in the vicinity of the pump.

The drain of the molten metal conducted by allowing free fall of the molten metal ensures that the level of the surface of the molten metal bath is maintained without requiring a large level controlling means. This also stabilizes the prevention of leakage of the molten metal through the gaps between the surfaces of steel strip S and the opposing longitudinal edges of slit 3. In contrast, use of a forced draining means, such as a pump, causes a change in the level of the molten metal bath due to fluctuation in the displacement of the pump. A change in the level of the surface of the molten metal bath brings about a corresponding change in the level of the electromagnetic force that prevents the leakage of the molten metal through the slit, so that the electromagnetic force has to be controlled in accordance with the change in the level of the molten metal surface. Such a control essentially requires an expensive control system and, hence, is preferably not employed. Alternatively, an exquisite and delicate control operation has to be performed to balance the rate of supply and the rate of drain of the molten metal into and out of the coating tank, so as to maintain a constant level of the surface of the molten metal bath. Such a control operation also requires expensive large-scale devices and, hence, is preferably avoided.

A molten metal supply system 10, having the following components, is annexed to coating tank 1: at least one auxiliary tank 13 which melts and holds the coating metal, a molten metal supply passage 12 through which the molten metal is supplied from auxiliary tank 13 to coating tank 1; a molten metal drain passage 11 through which the molten metal drained from coating tank 1 is returned to auxiliary tank 13; and a line change-over device 15. Thus, molten liquid supply system 10 circulates the molten metal between coating tank 1 and auxiliary tank 13.

In order to change the coating metal, and to replace the molten metal, it is preferred that a plurality of auxiliary tanks 13 are employed as illustrated. A line change-over device 15 selectively connects one of auxiliary tanks 13 to coating tank 1.

As noted above, the coating methods that use electromagnetic force to hold the molten metal bath have suffered from the problem of local rise of temperature of steel strip S or the molten metal due to induction heating caused by electrical currents induced in steel strip S or the molten metal. Circulation of the molten metal described above allows the molten metal to serve as a cooling medium which eliminates local building up of heat, thereby preventing the local rise of temperature.

In order to facilitate the supply and drain of the molten metal to and from coating tank 1, molten metal supply system 10 is located as close as possible to coating tank 1. The molten metal supply passage 12 is a hermetic passage that connects coating tank 1 and auxiliary tank 13, and permits supply of the molten metal to coating tank 1 without discontinuity before starting the coating operation. The molten metal drain passage 11 serves as the passage through which surplus molten metal drained from coating tank 1 is introduced into the auxiliary tank 13. Molten metal remaining in coating tank 1 after completion of the coating operation may be partly drained through molten metal supply passage 12 which may be opened for this purpose to the exterior, or may be carried away by depositing it on steel strip S.

There is no restriction in the method of supplying the molten metal from auxiliary tank 13 to coating tank 1. The molten metal supply system, however, preferably has a pump P in molten metal supply passage 12 so that the molten metal is supplied from the underside of coating tank 1, as shown in FIG. 1.

According to the present invention, a buffer 16 is provided in coating tank 1 or in the vicinity thereof in communication with the molten metal supply passage 12, for suppressing the pulsating flow of the molten metal.

Figure 2A:
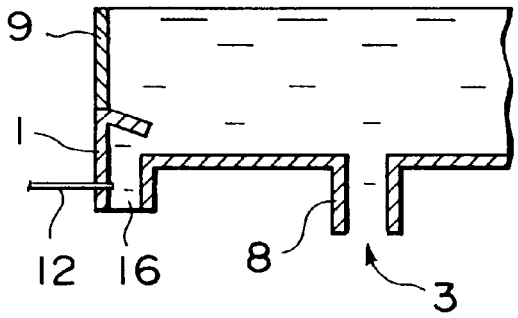
FIGS. 2A to 2C are schematic sectional views of examples of a buffer incorporated in the apparatus shown in FIG. 1.

In accordance with the invention, the molten metal circulated through the molten metal bath to serve as a cooling medium. Any variation of the flow velocity of the molten metal along the breadth of the steel sheet causes a corresponding variation of the cooling effect of the cooling medium along the breadth of steel strip S, resulting in a variation in the temperature of steel strip S or the molten metal. In order to uniformly distribute the flow velocity of the supplied molten metal along the breadth of steel strip S, the coating apparatus of the present invention has, for example, buffer 16 as shown in FIG. 2A, disposed within or in the vicinity of coating tank 1 in communication with molten metal supply passage 12. Buffer 16 provides a uniform distribution of flow velocity of the molten metal over the breadth of steel strip S to which the flow of the molten metal is directed. Buffer 16 can have any desired configuration and design, provided that it provides such a uniform distribution of flow velocity.

Figure 2B:
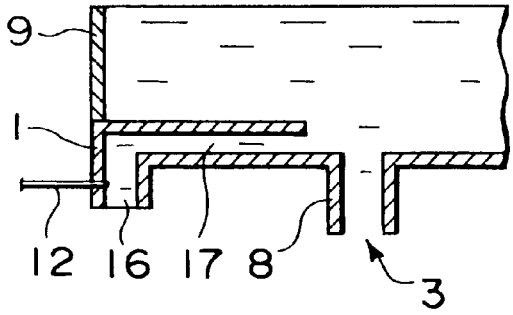
Figure 2C:
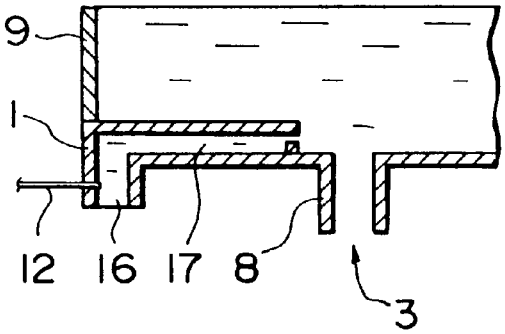

Preferably, a molten metal discharge passage 17 is provided in coating tank 1 in communication with buffer 16 so as to direct the molten metal towards steel strip S, as shown in FIG. 2B or 2C. Molten metal discharge passage 17 preferably has a slit-shaped outlet opposing steel strip S and extending in the direction of breadth of steel strip S.

It is preferred that the flow of the molten metal is directed to impinge upon steel strip S at a right angle or with a slight upward elevation angle. To this end, the outlet of molten metal discharge passage 17 is oriented at a right angle to or with a slight upward elevational angle to each surface of steel strip S, as shown in FIG. 2A or 2B. Such a direction of the flow of molten metal with respect to steel strip S conveniently contributes to development of high degree of uniformity of the molten metal in coating tank 1 without producing any undesirable effects on the molten metal bath inside coating tank 1. In contrast, supply of the molten metal in a direction parallel to steel strip S is not preferred, because the cooling effect of the molten metal serving as the cooling medium varies along the breadth of steel strip S, failing to meet the requirement of achieving a high degree of uniformity of the temperature of the steel sheet or the molten metal.

According to the present invention, suitable heating means (not shown) may be disposed on or around molten metal supply passage 12. It is also preferred that suitable dross removing means be disposed within or in the vicinity of auxiliary tank 13.

A reduction of the molten metal temperature causes supersaturating dissolved matters in the molten metal to precipitate and solidify to form a dross. In order to suppress formation of the dross, it is necessary that the circulated molten metal is maintained at a temperature high enough to keep the matters dissolved without precipitating. The heating means (not shown), such as a combination of an electric heater and heat insulating walls, is provided around molten metal supply passage 12 to minimize a temperature drop of the molten metal flowing through molten metal supply passage 12.

It is also preferred that the temperature of the molten metal inside molten metal supply passage 12 is not lower than that inside auxiliary tank 13 to minimize the risk of generation of dross. It will be seen that generation of dross tends to be promoted when the temperature of the molten metal in molten metal supply passage 12 is lower than that inside auxiliary tank 13.

Despite such an effort for maintaining the molten metal temperature, it is extremely difficult to completely avoid reduction of the temperature and, hence, generation of dross more or less is caused inevitably. In order to arrest and remove such dross, it is desirable that the aforesaid dross removing means be installed inside or in the vicinity of auxiliary tank 13. Preferably, a scheming-type dross removing device is used that separates the dross based on a difference in specific gravity. The dross removing means also may be a molten metal filter.

In the hot dip coating apparatus of the present invention, electromagnetic sealing device 2 may be of any type which can effectively hold the molten metal bath inside coating tank 1 without allowing the molten metal to leak through slit 3. Thus, any known electromagnetic force generating means can be used for this purpose. Preferably, however, the electromagnetic sealing device employs a pair of-magnetic field applying means, such as solenoid cores 2*a*, arranged under the bottom of coating tank 1 at a predetermined spacing from each other, at both sides of steel strip S; that is, at both sides of slit 3, so as to extend along projected portion 8 of coating tank 1, so as to produce and apply horizontal magnetic fields or moving magnetic fields. Molten metal 7 is held within coating tank 1 without leaking downward through slit 3 by the interaction between the magnetic fields produced by the magnetic field application means and the electric currents induced to flow in the molten metal.

An RF electromagnetic force generating device, for example, an RF magnetic field applying means, is optimally used as the means for applying horizontal magnetic fields. Preferably, the frequency of the magnetic fields applied by the RF electromagnetic field applying means ranges from 1 to 10 KHz.

The magnetic field applying means arranged along projected portion 8 of coating tank 1 may be of the type which applies moving magnetic fields instead of the horizontal magnetic fields. The frequency of the magnetic field produced by such moving magnetic field applying means preferably ranges from 10 to 1000 Hz.

A steel strip supporting device, generally denoted by 30, is disposed at the strip inlet side of coating tank 1. Steel strip supporting device 30 is capable of guiding to coating tank 1 a steel strip which has been annealed in a non-oxidizing or reducing atmosphere, without allowing oxidation of steel strip S on its way to coating tank 1.

More specifically, steel strip supporting device 30 includes a deflector roller 33 that vertically deflects the annealed steel strip S coming from an annealing furnace. Steel strip S then runs along support rollers 32 that level the steel strip S by removing any warp or deflection of the same. Steel strip S is then guided through the nip between guide rollers 31 that suppresses vibration of steel strip S and introduced into coating tank 1 so as to be continuously held in contact with the coating molten metal, whereby steel strip S is coated.

Although not essential, a doctoring device 20 may be provided at the strip outlet side of the coating apparatus, so as to squeeze and remove any surplus molten metal attaching to the steel sheet emerging from coating tank 1. Doctoring device 20 is preferably a gas wiping nozzle that blows surplus molten metal off the steel sheet.

In operation of the hot dip coating apparatus having the described construction, steel strip S is pulled upward into coating tank 1 through slit 3 so as to move upward through and in contact with the molten metal which is held inside coating tank 1 by the effect of magnetic fields applied to the molten metal by the pair of magnetic field applying means 2*a* arranged at both sides of steel strip S at a predetermined spacing from each other, while circulation of the molten metal is maintained so that the molten metal is supplied from auxiliary tank 13 to a lower portion of coating tank 1 through molten metal supply passage 12 and the molten metal drained by overflowing the top end of dam 9 is returned to auxiliary tank 13 through molten metal drain passage 11.

Preferably, the rate of circulation of the molten metal between coating tank 1 and the auxiliary tank is 100 liter/min. or greater so that the molten metal provides sufficient cooling effect to realize a uniform distribution of the strip temperature or the molten metal temperature along the breadth of steel strip S.

Figure 3A:
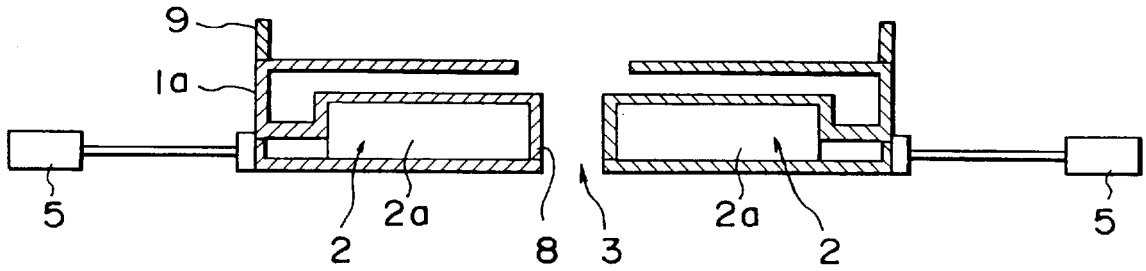
FIGS. 3A and 3B are schematic sectional views of examples of a split-type coating tank incorporated in the apparatus shown in FIG. 1.
Figure 3B:
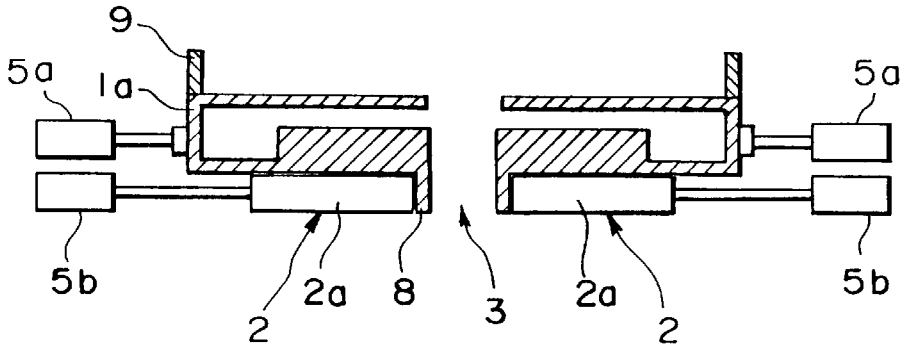

As shown in FIGS. 3A and 3B, coating tank 1 used in the hot dip coating apparatus of the present invention has a split-type structure composed of two halves or tank sections 1*a* which oppose each other across the steel sheet. Tank sections la are provided with their own moving means 5/5*a* so that they are movable towards and away from steel strip S. Moving means 5/5*a* may be, for example, pneumatic cylinders, hydraulic cylinders, worm gears, or other suitable means.

In the illustrated embodiment of the hot dip coating apparatus in FIG. 3B, magnetic field applying means 2*a* are equipped with their own moving means 5*b*, so that they are movable towards and away from steel strip S. Moving means 5*b* may be, for example, pneumatic cylinders, hydraulic cylinders, worm gears, or other suitable means. Magnetic field applying means 2*a* may be fixed to the associated tank sections 1*a* or may be arranged for movement relative to these tank sections. Obviously, moving means for moving each magnetic field applying means 2*a* alone must be employed if the magnetic field applying means has to be movable independently of the associated tank section.

Figure 5:
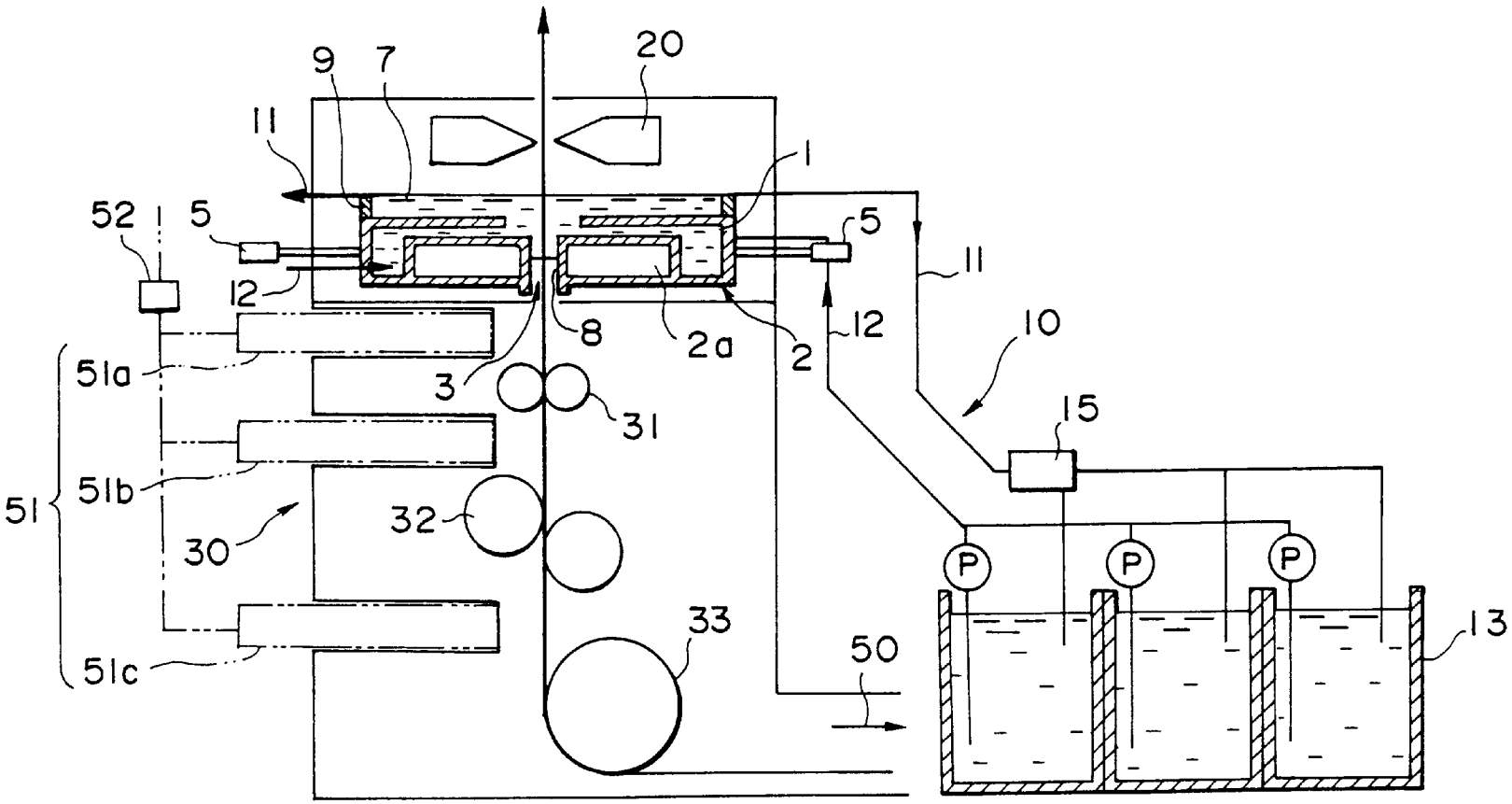
FIG. 5 is a schematic sectional view of a second embodiment of the hot dip coating apparatus in accordance with the present invention.

With reference to FIG. 5, the hot dip coating apparatus of the present invention preferably has a strip profile measuring device 51 arranged upstream of the slit of coating tank 1 as viewed in the direction of movement of steel strip S. Strip profile measuring device 51 measures any warp (C-warp and W-warp) of steel strip S, as well as amplitudes of vibration and winding. The warp of steel strip S is measured by using a plurality of warp measuring sensors 5*b* arranged at a plurality of locations along the breadth of steel strip S, or by employing a single scanning-type measuring device. Preferably, warp measuring sensor 51*b* is of the type employing an infrared laser telemeter. The position of measurement is preferably immediately above support rollers 32 of steel strip supporting device 30. A strip vibration measuring device 51*a* may be used to measure the vibration of steel strip S. Preferably, strip vibration measuring device 51*a* is of the type employing an infrared laser telemeter. The position of measurement is preferably immediately above guide rollers 31 of steel strip supporting device 30. The amplitude of the winding is detected by a steel strip winding measuring device 51*c* which is preferably a steel strip position sensor 51*c*. The measurement may be conducted above deflector roller 33, although this is not required.

The hot dip coating apparatus of the invention preferably includes a profile judging device 52 which detects any irregularity of the strip profile based on signals received from steel strip profile measuring device 51. In case that one of the values measured by the strip profile measuring device 51 exceeds a predetermined upper limit, the profile judging device generates a signal indicative of occurrence of an abnormal state. Measurements are taken in response to this signal, in order to avoid an accident, such as contact of the steel sheet with the side edge of slit 3 or with the wall of coating tank 1. The aforesaid predetermined upper limit value may be set, for example, at a position which is 10 mm spaced inward from each side edge of slit 3. Thus, when the position of steel strip S as measured is between a side edge of slit 3 and a position 10 mm spaced therefrom, the above-mentioned signal indicative of occurrence of abnormal state is generated, because in such a case a large risk exists of accidental contact of steel strip S with the edge of slit 3.

In the hot dip coating apparatus in accordance with the present invention, coating tank 1 has a split-type structure composed of a plurality of separable tank sections 1*a* arranged to oppose each other across steel strip S, and the tank sections and associated magnetic field applying means 2*a* independently or integrally move such that the distance between the tank sections increases and decreases. An on-line measurement of the profile of steel strip S is performed at a location upstream of slit 3 and, when a measured value exceeds a predetermined limit, a the velocity of steel strip S is immediately retarded, preferably to a velocity of from 30 to 50 mpm. At the same time, the supply of the molten metal to coating tank 1 is ceased and the molten metal remaining in coating tank 1 is drained. Thereafter, tank sections 1*a* and magnetic field applying means 2*a* are retracted from the pass line.

A stroke of each movable tank section, which can provide a distance of 50 mm or greater between steel strip S surface and opposing side edge of slit 3, is sufficient for avoiding accidental contact between steel strip S and the opposing side edge of slit 3, when the degree of irregularity is within the range which is usually observed. A stroke exceeding 150 mm will be large enough to avoid accidental contact between steel strip S and the side edge of slit 3, for the maximum credible irregularity of the profile or position of steel strip S, so that an accident, such as damaging of the edges of slit 3, can be almost entirely avoided.

Magnetic field applying means 2*a* are juxtaposed to coating tank 1. Magnetic field applying means 2*a* need not be moved if they do not hinder the movement of the tank sections 1*a*. If they hamper the movements of the tank sections 1*a*, however, it is preferred that each of magnetic field applying means 2*a* is moved together with or independently of the associated tank section 1*a*. Obviously, the construction of moving means can be simplified if each magnetic field applying means 2*a* moves together with the associated tank section 1*a*.

After the retraction of the tank sections 1*a* and the magnetic field applying means 2*a*, an operator observes the profile of steel strip S and effects necessary adjustments to correct the strip profile, pass line of steel strip S and so forth. After confirming that the steel sheet can run along a predetermined pass line, the operator controls the apparatus so as to bring the tank sections 1*a* and the magnetic field applying means 2*a* to predetermined positions, and to start the supply of the molten metal into coating tank 1, thus re-starting the coating operation. Such adjustment or corrections may be conducted after stopping steel strip S, in the event of an extremely inferior strip profile.

Figure 4A:
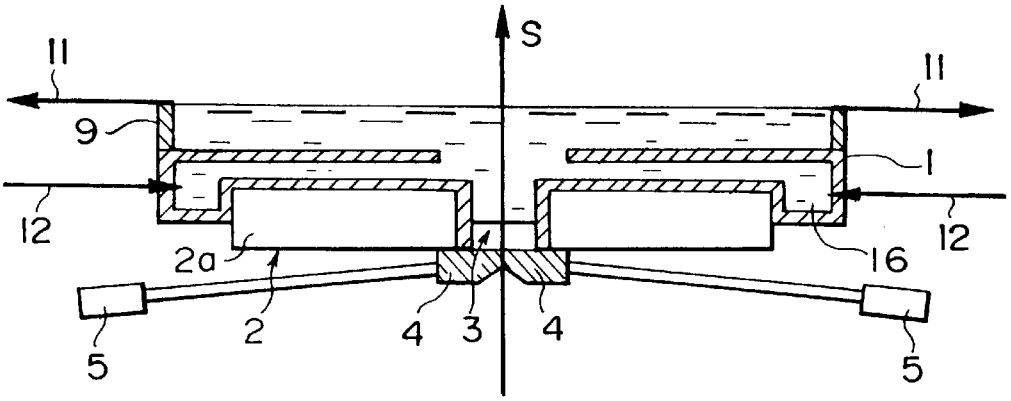
FIGS. 4A to 4F are schematic sectional views of examples of a sealing member incorporated in the apparatus shown in FIG. 1.
Figure 4B:
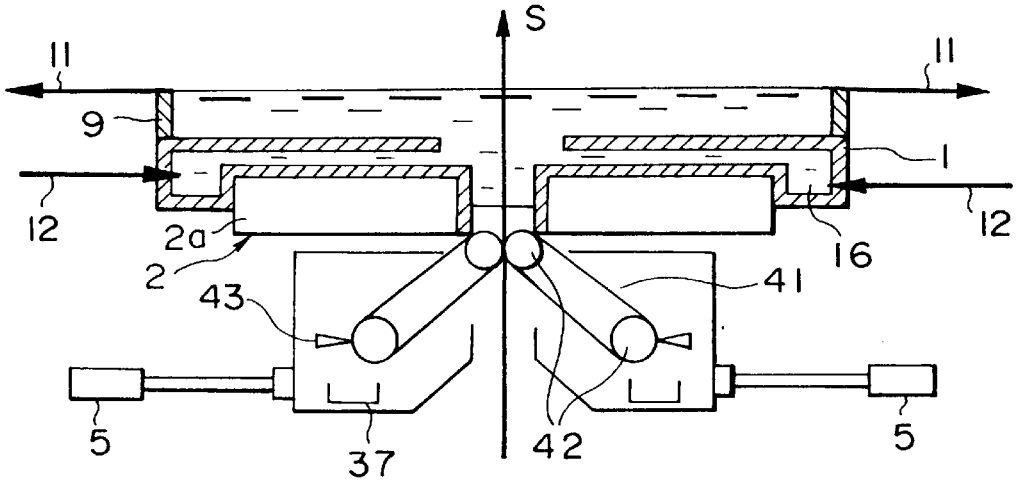
Figure 4C:
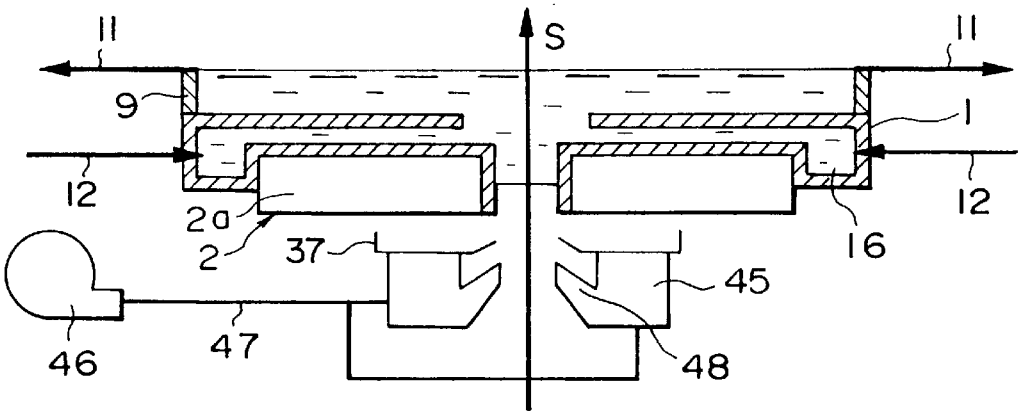

With reference now to FIGS. 4A–C, the hot dip coating apparatus of the present invention preferably includes coating tank 1 provided with slit 3, an electromagnetic sealing device 2 which generates an electromagnetic force to hold the molten metal, and sealing members 4 (see FIG. 4A) which prevents downward leakage of the molten metal.

Preferably, sealing members 4 are held in contact with steel strip S, so as to prevent any leaking molten metal onto the components which are installed below coating tank 1.

In general, most of the molten metal leaking through slit 3 falls down along steel strip S which is running upward, so as to be arrested and temporarily held on the sealing members, and attaches to the upwardly running steel strip. Sealing members 4 can have any suitable shape which ensures contact between the sealing members and steel strip S surfaces. It is to be understood, however, that sealing members 4 may be arranged in a non-contacting manner, for example with a minute gap of 2 mm or so between sealing member 4 and steel strip S, provided that such a gap is small enough to prevent downward leakage of the molten metal temporarily held by sealing member 4. Sealing member 4 is preferably adapted to be moved into and out of contact with steel strip S, by a suitable moving means which is preferably, but not limited to, a hydraulic cylinder or a pneumatic cylinder.

Preferably, sealing member 4 is made of a material which is highly resistant to erosion caused by hot metal, as well as to heat. For instance, ceramics of carbides, oxides, nitrides, silicides or borides, as well as a material coated with a material resistant to erosion by hot metal, e.g., cermet such as WC—Co, sprayed thereto, can suitably be used as the material of the sealing member. Felt-type material using ceramics fibers, e.g., kao wool, glass wool or the like, may also be used as the material of the sealing member.

It is also possible to use a heat-resistant belt 41 as the sealing member, as in the embodiment shown in FIG. 4B. The heat-resistant belt 41 is disposed at each side of steel strip S. Each belt 41 is stretched between rotatable support rollers 42 which, together with the belt 41, form a heat-resistant belt assembly. The heat-resistant belt assembly-is movable into and out of contact with steel strip S by sealing member moving means 5. Support rollers 42 may be non-powered so as to be driven by the belt 41 which in turn is driven by steel strip S by friction, or one or both of support rollers 42 of each belt assembly may be power driven.

Molten metal leaking through slit 3 is held between each belt and the opposing surface of steel strip S. Part of the molten metal thus held is carried upward by the running steel strip, while the remainder attaches to the heat-resistant belt. Preferably, a molten-metal scraping device 43, such as a scraper blade, is arranged in contact with the running heat-resistant belt, so that the molten metal attaching to the belt is scraped off the belt by the scraping device. Any suitable collecting means may be used to collect the molten metal, such as a molten metal collecting vessel or a suction device capable of sucking the scraped molten metal. It is also preferred that a molten metal collecting hood is provided to prevent the molten metal from scattering during collection.

The hot dip coating apparatus of the present invention may employ a gas-jet sealing device arranged immediately below the bottom slit of coating tank 1. This gas-jet sealing device jets a gas which blows off the molten metal leaking from the bottom slit to prevent contamination of the components arranged below slit 3.

A shown in FIG. 4C, a pair of such gas-jet sealing devices 48 may be arranged on opposing sides of steel strip S. No restriction is imposed on the configuration and the construction of the gas sealing device 48. For example, gas-jet sealing device 48 may have a blower 46 which is connected through a pipe 47 to gas jetting device 48 arranged in the vicinity of steel strip S surface, so that the gas blown by blower 46 is jetted from gas jetting device 48 to blow the leaked molten metal off the surface of steel strip S. Preferably, the direction of the gas jet is determined such that the jetted gas impinges upon the surface of steel strip S at a slight upward elevation angle with respect to the strip surface. The molten metal blown off steel strip S is collected in a collecting vessel disposed in the vicinity of the gas-jet sealing device or by a suitable suction means capable of sucking the molten metal. There is no restriction in regard to the rate and pressure at which the gas is applied, provided that the jet of the gas can satisfactorily blow the molten metal off the steel sheet. In order to minimize vibration of steel strip S. however, it is preferred that the gas flow rate ranges from 10 to 500 $Nm^3$/min, and that the gas pressure ranges from 50 to 500 mm Aq. No specific restriction is posed on the type of the gas, although nitrogen gas, hydrogen gas argon gas or a mixture of such gases can suitably be used. The gas may even be heated.

Figure 4D:
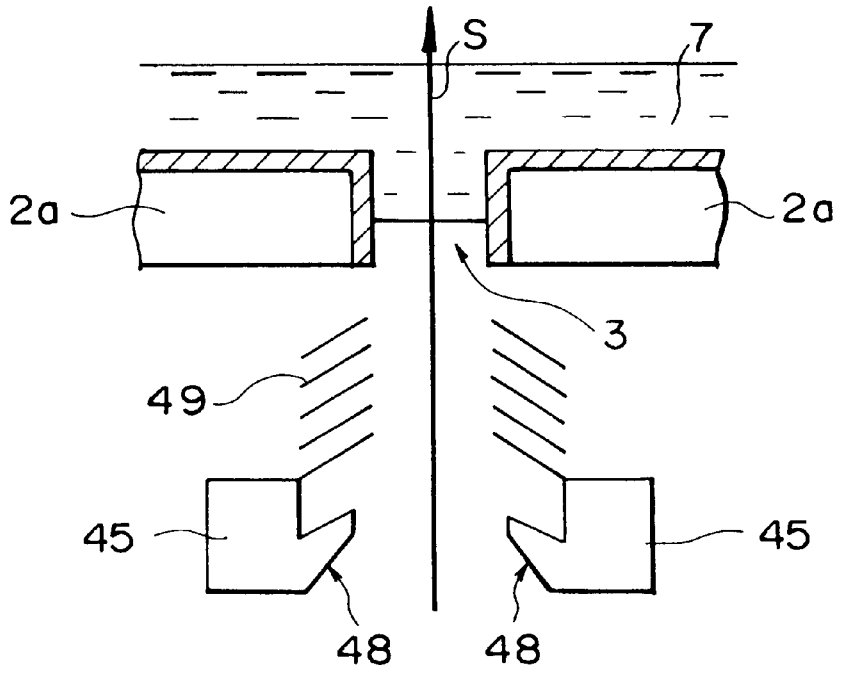
Figure 4E:
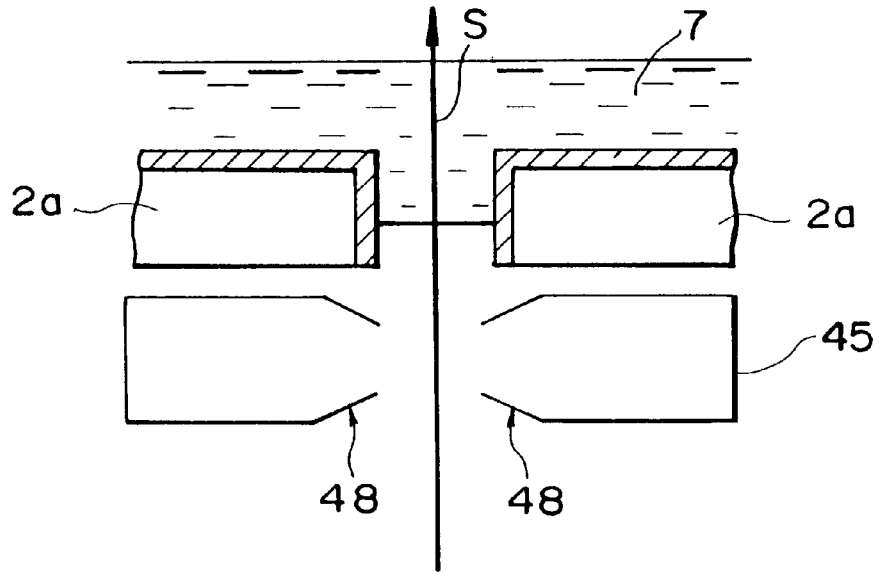

Modifications of the gas-jet sealing devices are shown in FIGS. 4D and 4E. The gas-jet sealing device shown in FIG. 4D has a construction similar to that shown in FIG. 4C, but has partition plates 49 arranged above the position of the gas-jet sealing device. Partition plates 49 enable efficient collection of the blown molten metal by suppressing excessive scattering of the molten metal.

Referring now to FIG. 4E, a plurality of gas-jetting devices 48 are arranged to jet the gas perpendicularly to the surfaces of the steel sheet. The gas jetted from gas jetting devices 48 not only blows the coating liquid but also serves as a gas damper which effectively suppresses the vibration of steel strip S.

The coating operation of the described apparatus will now be described, in particular the operation for starting the coating and the operation conducted after the coating is finished.

Steel sheet S is driven to run at a predetermined velocity, and the sealing members 4 are brought into contact with steel strip S or to a position in the close proximity of steel strip S.

Then, after starting the application of a magnetic field to the space inside coating tank 1, molten metal is supplied into coating tank 1, while the magnetic field effectively serves to hold the molten metal inside coating tank 1. Molten metal which has leaked from coating tank 1 during the supply of the molten metal is held between each sealing member 4 and the opposing surface of steel strip S attaches to steel strip S so as to be held outside of the system. It is thus possible to protect the components under slit 3 from being contaminated by the molten metal. After the effect of the electromagnetic force has become large enough to hold the molten metal in coating tank 1, the leakage of the molten metal through slit 3 ceases. In the meantime, molten metal which has leaked through slit 3 and accumulated on sealing members 4 is carried upward by the running steel strip, so that no molten metal remains on sealing members 4. In this state, the sealing members are moved out of contact with steel strip S.

Thus, the molten metal which has leaked through the bottom slit is caught by the sealing members brought into contact with or in the close proximity of the running steel strip, so that the leaked molten metal is prevented from falling onto the components under the bottom slit of coating tank 1. Instead of relying upon the sealing members, the arrangement may be such that a jet of a gas is blown against the surfaces of steel strip S so as to blow the leaked molten metal off steel strip S. Preferably, the gas jet thus applied has a velocity component parallel to the direction of running of steel strip S. It is also possible to simultaneously use both sealing members 4 and the jet of the gas.

The operation at the end of the coating process is as follows. While the coating operation is still in progress, sealing members 4 are brought to predetermined positions in close proximity to the surfaces of the running steel strip. The supply of the molten metal to coating tank 1 is then terminated. Then, the gas wiping device is stopped so as to allow the molten metal to be carried upward by the running steel strip to evacuate coating tank 1. Alternatively, the molten metal remaining in coating tank 1 is shifted back to auxiliary tank 13, through molten metal supply passage 12, so that coating tank 1 is evacuated. When coating tank 1 is empty, magnetic field applying means 2*a* is turned off and steel strip S is stopped, followed by driving of sealing member 4 away from steel strip S. It is thus possible to prevent the components below slit 3 from being contaminated by molten metal which may have leaked through slit 3 in the transitory period immediately after the start of coating or after coating is finished.

Figure 4F:
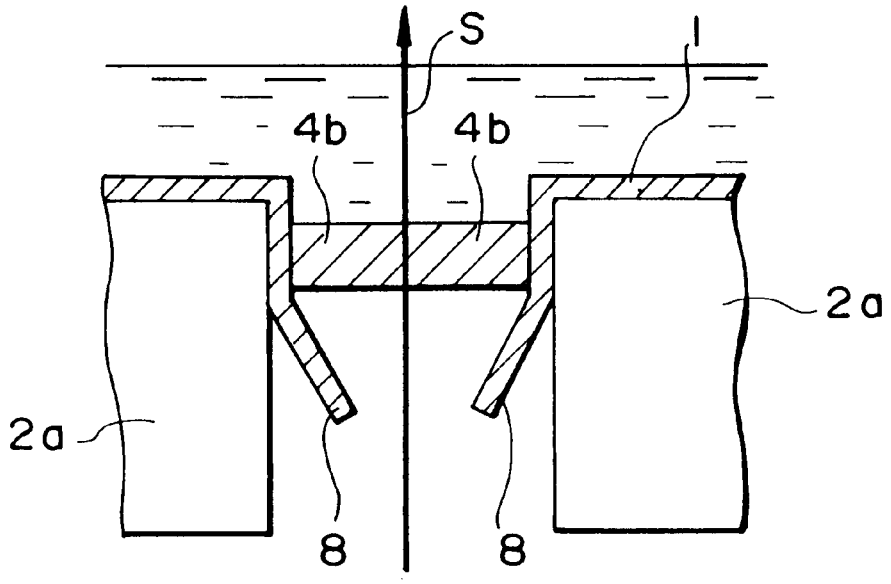
Figure 4F:
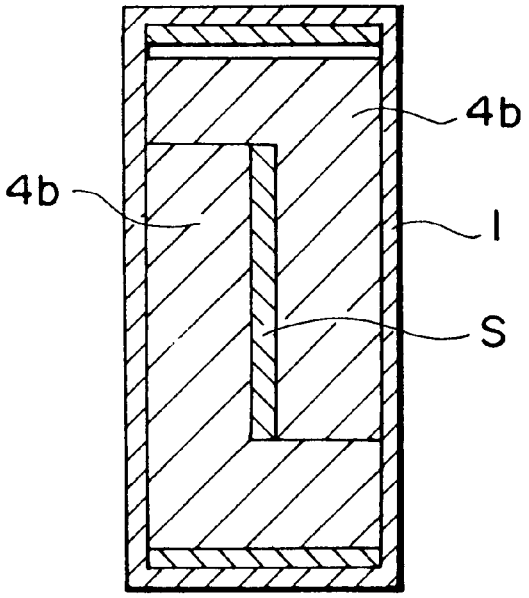

With reference to FIG. 4F, it is also preferred that a pair of sealing members 4*b* are disposed in slit 3 or at a position immediately above slit 3 so as to close slit 3 when starting the coating. Preferably, sealing members 4*b* are fixed to coating tank 1 so as not to be moved by the running steel strip due to friction.

Such sealing members 4*b* effectively prevent the molten metal from leaking through slit 3, particularly in the period immediately after start when the level of the molten metal surface fluctuates, so as to eliminate deposition of the molten metal onto the components immediately below slit 3 such as steel strip supporting device 30.

Sealing members 4*b* are made of a material meltable at a temperature equal to or below the melting temperature of the coating metal. Thus, a metal or an alloy which is the same as the molten metal can suitably be used as the material of sealing members 4*b*. It is also possible to use, as the material of sealing members 4*b*, an alloy containing the same elements as the molten metal of the coating bath but the composition ratio should be adjusted to provide a melting temperature lower than that of the molten metal of the coating bath.

There is no restriction in regard to the configurations of sealing members 4*b*, provided that the pair of sealing members 4*b* can effectively close slit 3. For instance, sealing members 4*b* having a configuration as shown in FIG. 4F (f-2) can suitably be used.

A pair of L-shaped sealing members 4*b* having a breadth corresponding to that of steel strip S can completely close slit 4 and, hence, can be used effectively for any type of steel strips.

A description will now be given of a coating process in which the coating operation is commenced by using the above-described apparatus.

The pair of sealing members are situated within or just above slit 3. Then, steel strip 3 is started, and the supply of the molten metal into coating tank 1 is commenced. Then, a horizontal magnetic field is applied to the molten metal inside coating tank 1 by means of magnetic field applying means 2*a* of electromagnetic sealing device 2. In the meantime, no leakage of the molten metal occurs because sealing members 4*b* effectively serve to prevent such leakage of the molten metal. The supply of the molten metal into coating tank 1 is conducted quickly so that the surface of the molten metal inside coating tank 1 reaches a predetermined level. Melting of sealing members 4*b* then occurs due to heat transmitted from the molten metal or heat generated by inducted electrical currents. When such melting takes place, however, the level of the molten metal surface inside coating tank 1 has already been settled, so that no fluctuation of the level of the molten metal surface which would cause leakage of the molten metal takes place. Consequently, the molten metal inside coating tank 1 is stable due to the effect of the electromagnetic force. It is thus possible to avoid contamination of the components immediately below slit 3 by the molten metal.

According to the present invention, it is also preferred that guide rollers 31 are equipped with a scraping device 35 for scraping the molten metal. More specifically, guide rollers 31 are disposed below slit 3. Molten metal leaked through slit 3, if any, flows downward along steel strip S so as to be caught by and temporarily held in the nip between each guide roller 31 and steel strip S. Part of the molten metal thus held attaches to steel strip S so as to be conveyed upward, while the remainder part of the molten metal attaches to and clings about each guide roller 31. The molten metal clinging about guide roller 31 is then mechanically scraped off roller 31 by scraping device 35, so as to be collected in a molten metal collecting vessel.

Although the invention does not pose any restriction on the material of guide rollers 31, it is preferred that guide rollers 31 are made of a material which is repellent to the molten metal or coated with such a material, so as to facilitate the scraping of the molten metal performed by scraping device 35. Preferably, ceramics of carbides, oxides, nitrides, silicides or borides can suitably be used as the material of guide rollers 31 or the material that coats guide rollers 31.

Scraping device 35 is preferably arranged to extend over the entire breadth of guide rollers 31, and can have an integral or a split-type structure. Preferably, a suitable urging device 36, such as a pneumatic cylinder or a hydraulic cylinder, is associated with scraping device 35. The level of the force exerted by urging device 36 at which scraping device 35 is urged against guide rollers 31 is suitably controlled so as to suppress wear or degradation of scraping device 35. Preferably, a collecting vessel is arranged to receive the molten metal which has been scraped off guide rollers 31 by scraping device 35.

EXAMPLES

Example 1

Hot dip zinc coating was conducted on strips of an ultra-low carbon steel by using the hot dip coating apparatus of FIG. 1. Coating tank 1 of the hot dip coating apparatus has an overflow dam 9 over which the molten metal flows so as to be drained from coating tank 1. Overflow dam 9 is situated on the tops of the walls of coating tank 1, so that the level of the bath of the molten metal was maintained constant.

The molten metal had a predetermined composition and held at a predetermined temperature in auxiliary tank 13. The molten metal was supplied from auxiliary tank 13 to the lower part of coating tank 1 by means of a pump P through molten metal supply passage 12. Coating operations were conducted by selectively using buffers. Namely, in some cases, the molten metal was supplied through buffers 16 arranged to oppose to each other across steel strip S and was discharged towards the surfaces of the upwardly running steel strip from the molten metal discharge passages, in accordance with the requirement of the present invention, thus providing examples of the invention. In other cases, the buffers were not used: namely, the molten metal was directly supplied onto the steel strip from the outlet of molten metal supply passage 12, thus providing comparative examples. The molten metal discharge passage had an outlet having a slit-like configuration 30 mm wide and 2400 mm long, and was arranged to supply the molten metal perpendicularly to the running steel strip. The internal volume of the buffer was 50 liters.

The size of slit 3 was 2000 mm long as measured in the breadthwise direction of steel strip S and 20 mm as measured in the thicknesswise direction of steel strip S. The steel strip was introduced into coating tank 1 through slit 3 by being pulled upward.

Although not shown in FIG. 1, steel strip S had been subjected to an ordinary pre-treatment: namely, it had been cleaned and annealed. The pre-treated steel strip was then made to run through steel strip supporting device 30 which served to deflect the running strip into vertical direction and to eliminate any warp of steel strip S, and was introduced into coating tank 1 through slit 3, whereby the surfaces of the steel strip were coated with the metal of the melt. The amount of the coating metal deposited on the steel strip surfaces was regulated by doctoring device 20. The conditions of the coating operations were as shown below.

Type of the steel strip coated: Ultra-low carbon steel

Size of steel strip: breadth 1200 mm, thickness 1.0 mm

Strip running speed: 130 mpm

Molten metal composition: Zn+0.2% Al

Molten metal circulation rate: 400 l/min

Level of the molten metal surface inside tank: 200 mm

Amount of deposition: 45 g/m$^2$ on each surface (regulated by $N_2$ gas)

Frequency of A.C. power supplied to magnetic field applying device: 2 KHz

Magnetic flux density between cores of magnetic field applying device: 0.5 T

Test pieces were cut from random portions of the coated steel strips, for observation and evaluation in terms of the state of deposition of dross, state of growth of alloy layer and adhesion of the coating layer.

The coating adhesion was evaluated in accordance with the Du Pont impact test as specified by JIS K 5400. The results are shown in Table 1 in which a mark ○ is given to the samples exhibiting sufficiently high degree of coating adhesion. A mark Δ is given to each case where a slight separation of the coating layer was observed, and a mark x for each case where the whole coating layer came off.

TABLE 1

| Sample No. | Molten metal circulation rate l/min | Steel sheet temp. immediately before coating (° C.) | Molten metal temp. (° C.) Aux. tank | Molten metal temp. (° C.) Supply passage | Buffer | State of dross deposition | Formation of alloy layer | Coating adhesion | Remarks * |
|---|---|---|---|---|---|---|---|---|---|
| 1 | 400 | 475 | 470 | 470 | Used | Good | Good | ○ | Example |
| 2 | 400 | 490 | 480 | 480 | Used | Good | Good | ○ | Example |
| 3 | 400 | 470 | 455 | 455 | Used | Good | Good | ○ | Example |
| 4 | 400 | 505 | 490 | 490 | Used | Good | Good | ○ | Example |
| 5 | 400 | 470 | 460 | 460 | Used | Good | Good | ○ | Example |
| 6 | 400 | 475 | 470 | 470 | Not used | Good | Heavy local growth | Δ | Comparative ex. |
| 7 | 400 | 475 | 460 | 460 | Not used | Good | Heavy local growth | Δ | Comparative ez. |

TABLE 1-continued

| Sample No. | Molten metal circulation rate l/min | Steel sheet temp. immediately before coating (° C.) | Molten metal temp. (° C.) Aux. tank | Molten metal temp. (° C.) Supply passage | Buffer | State of dross deposition | Formation of alloy layer | Coating adhesion | Remarks * |
|---|---|---|---|---|---|---|---|---|---|
| 8 | 400 | 470 | 460 | 455 | Not used | Deposition on whole surface | Heavy local growth | Δ | Comparative ex. |
| 9 | 400 | 470 | 490 | 450 | Not used | Deposition on whole surface | Heavy local growth | Δ | Comparative ex. |
| 10 | 400 | 470 | 480 | 460 | Not used | Deposition on whole surface | Heavy local growth | Δ | Comparative ex. |

Good: High uniformity in breadthwise direction
Remarks * : Example means Example of invention.
Comparative ex. means Comparative example.

From Table 1, it will be seen that the samples which were coated with the use of the buffers in accordance with the present invention exhibit high degree of uniformity of growth of the alloy layer along the strip breadth, as well as sufficiently high degrees of coating adhesion.

In contrast, the steel strips of Comparative Examples, which were coated without the use of the buffers showed locally rapid growth of the alloy layer, as well as inferior coating adhesion. In addition, samples which were coated under such condition that the temperature of the molten metal in the molten metal supply passage was lower than that in the auxiliary tank exhibited deposition of dross over the entire surfaces of the steel strips.

Figure 6:
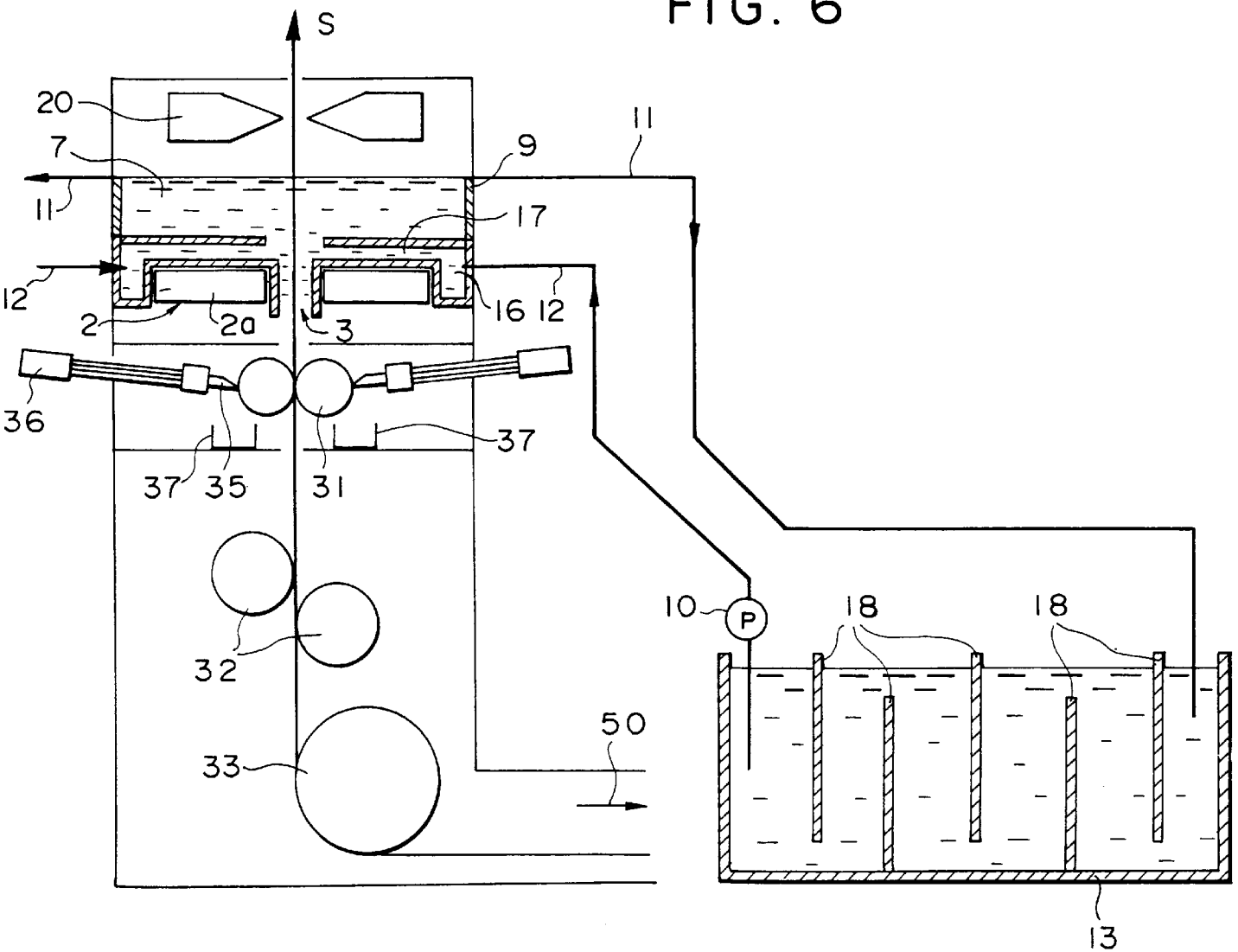
FIG. 6 is a schematic sectional view of a third embodiment of the hot dip coating apparatus in accordance with the present invention.
Figure 7:
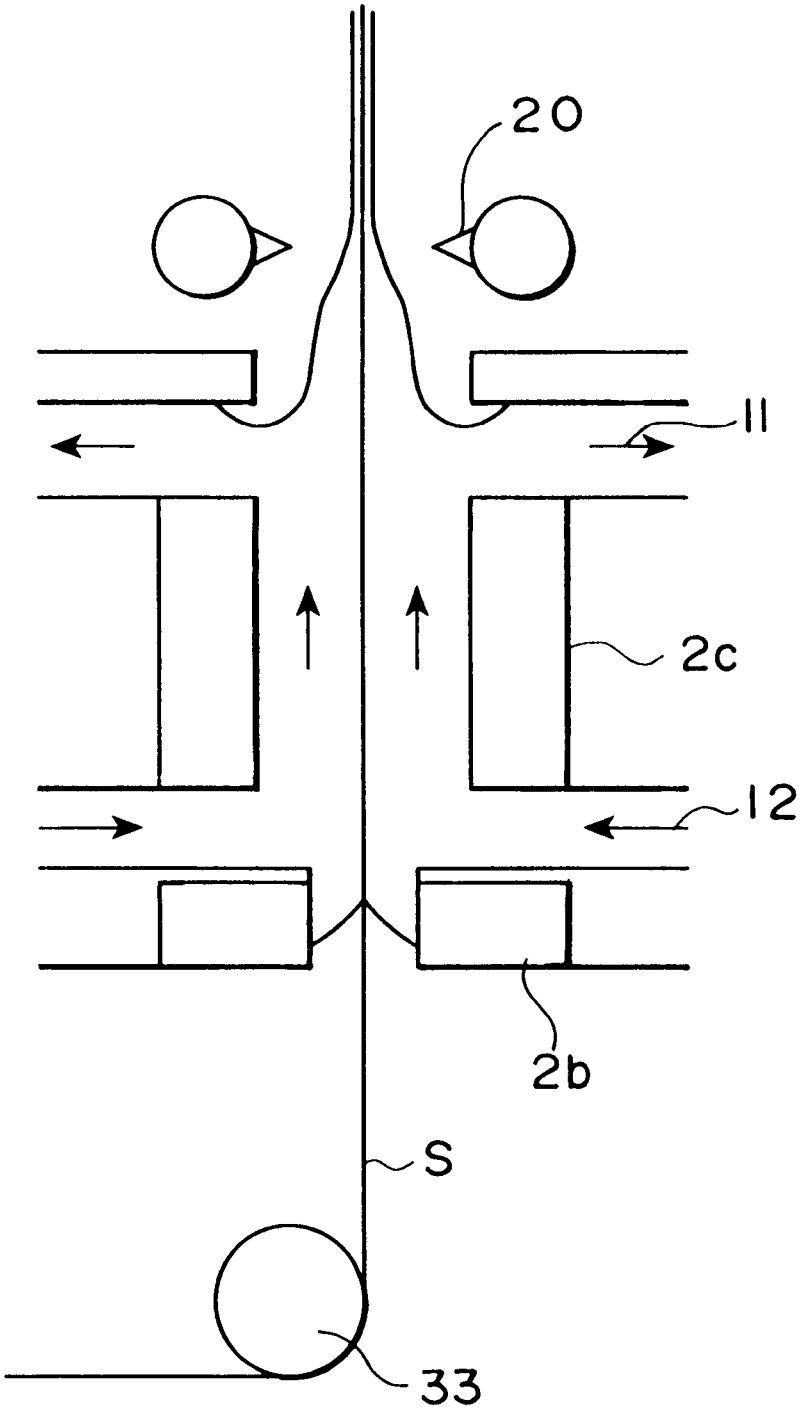
FIG. 7 PRIOR ART
FIG. 7 is a schematic illustration of a known hot dip coating apparatus.

Example 1, except that the rate of circulation of the molten metal was controlled. The hot dip coating apparatus was the same as that shown in FIG. 1, but was provided with the dross removing means as shown in FIG. 6, as well as heating means (not shown) provided on the molten metal supply passage. As in Example 1, test pieces were extracted from random portions of the sample coated strips for evaluation of the state of deposition of dross, state of growth of alloy layer and coating adhesion. The results are shown in Table 2.

TABLE 2

| Sample No. | Molten metal circulation rate l/min | Steel sheet temp. immediately before coating (° C.) | Molten metal temp. (° C.) Aux. tank | Molten metal temp. (° C.) Supply passage | Buffer | State of dross deposition | Formation of alloy layer | Coating adhesion | Remarks * |
|---|---|---|---|---|---|---|---|---|---|
| 11 | 800 | 475 | 465 | 470 | Used | Good | Good | ○ | Example |
| 12 | 400 | 475 | 465 | 470 | Used | Good | Good | ○ | Example |
| 13 | 120 | 475 | 465 | 470 | Used | Good | Good | ○ | Example |
| 14 | 80 | 475 | 465 | 470 | Used | Good | Growth at strip edge | ○ | Example |
| 15 | 50 | 475 | 465 | 470 | Used | Local deposition | Growth at strip edge | ○ | Example |
| 16 | 800 | 475 | 465 | 470 | Not used | Good | Heavy local growth | Δ | Comparative ex. |
| 17 | 400 | 475 | 465 | 470 | Not used | Good | Heavy local growth | Δ | Comparative ex. |
| 18 | 120 | 475 | 465 | 470 | Not used | Local deposition | Heavy local growth | Δ | Comparative ex. |
| 19 | 80 | 475 | 465 | 470 | Not used | Local deposition | Heavy growth over whole surface | x | Comparative ex. |
| 20 | 50 | 475 | 465 | 470 | Not used | Local deposition | Heavy growth over whole surface | x | Comparative ex. |

Good: High uniformity in breadthwise direction
Remarks * : Example means Example of invention.
Comparative ex. means Comparative example.

Although hot dip coating process has been described with specific reference to coating with Zn, it is to be appreciated that the advantages brought about by the coating apparatus and method of the present invention can equally be enjoyed when such apparatus and method are used with other types of coating metals such as Al, Pb, Sb, Mg and so forth. It is also to be understood that the present does not exclude an alloying treatment which is effected by heating after the regulation of the amount of deposition of the coating metal performed by the doctoring device.

Example 2

Hot dip zinc coating operations on ultra-low carbon steel strips were conducted under the same conditions as those in Referring to Table 2, steel strips of Sample Nos. 11 to 13 which were coated under circulation of the molten metal at rates not smaller than 100 l/min, among the samples which were coated in accordance with the invention with the use of the buffers through which the molten metals were supplied, showed high degree of uniformity of growth of the alloy layer along the breadth of the strips, as well as sufficiently high level of coating adhesion.

Among Samples coated in accordance with the invention, Sample Nos. 14 and 15 which were coated under circulation of the molten metal at rates less than 100 liters/min showed rapid growth of the alloy layer at a local portion of breadthwise ends of the strip, but they showed satisfactory levels of coating adhesion.

Samples of Comparative Examples, which were coated under the supply of the molten metal directly onto the steel strips without using the buffer showed local rapid growth of alloy layer and inferior coating adhesion. In particular, Sample Nos. 19 and 20 which were coated under molten metal circulation rates of less than 100 liters/min showed heavy growth of alloy layers over the entire surfaces of the strips, and extremely inferior coating adhesion.

Deposition of dross was not observed at all or, if not, only slight and negligible, by virtue of the provision of the heating means on the molten metal supply passage and the provision of the dross removing device in the auxiliary tank.

Example 3

Hot dip zinc coating operations were performed on ultra-low carbon steel strips by means of the hot dip coating apparatus shown in FIG. 5. Coating tank 1 used in this Example had a split-type structure composed of a pair of tank sections which were movable respectively to positions 300 mm apart from the steel strip by means of moving means 5*a* constituted by pneumatic cylinders. Magnetic field applying means 2*a* were fixed to the coating tank sections. The coating apparatus also had steel strip profile measuring device 51 arranged in a steel strip supporting device 30, and a profile judging device which receives signals from the profile measuring device 51.

Although not shown in FIG. 5, the steel strip S to be coated had been subjected to an ordinary pre-treatment: namely, it had been cleaned and annealed. The pre-treated steel strip was then made to run through the steel strip supporting device 30 which served to deflect the running strip into vertical direction and to eliminate any warp of the strip, and was introduced into coating tank 1 through slit 3, whereby the surfaces of the steel strip were coated to the metal of the melt. The amount of the coating metal depositing on the steel strip surfaces was regulated by doctoring device 20. The conditions of the coating operations were as shown below.

Type of the steel strip coated: Ultra-low carbon steel

Size of steel strip: breadth 1200 mm, thickness 1.0 mm

Strip running speed: 130 mpm

Molten metal composition: Zn+0.2% Al

Molten metal temperature: 475° C.

Strip temperature immediately before coating: 480° C.

Molten metal supply rate: 400 l/min

Level of the molten metal surface inside tank: 200 mm

Amount of deposition: 45 g/m$^2$ on each surface (regulated by $N_2$ gas)

Frequency of A.C. power supplied to magnetic field applying device: 2 KHz

Magnetic flux density between cores of magnetic field applying device: 0.5 T

The steel strip profile was measured by steel strip profile measuring device 51 in terms of the deviation from the neutral or central position towards either side edge of slit 3. An upper limit was set to a value corresponding to a position which is spaced 10 mm inward from each side edge of slit 3. When the deviation as measured by the profile measuring device exceeded the limit value, i.e., when the steel strip surface has approached either side edge of slit 3 beyond the position 10 mm apart from the side edge, the profile judging device produced a signal indicative of occurrence of an extraordinary state.

When this signal was produced, the steel strip was retarded to 40 mpm without delay, and the supply of the molten metal to coating tank 1 was stopped, followed by draining of the molten metal inside coating tank 1. Thereafter, the coating tank sections and the magnetic field applying means were retracted 60 mm with respect to the steel strip. The profile of the steel strip was then observed and corrected as necessary. After confirming that the steel sheet can run along the predetermined pass line, the coating tank sections and the magnetic field applying means were moved to predetermined positions. Then, supply of the molten metal into coating tank 1 was commenced again while the magnetic field applying means applied the magnetic field, thus re-starting the normal coating operation. Thus, damaging of the side edges of slit 3 which otherwise may have occurred due to contact with the running steel strip was completely avoided.

Example 4

Hot dip zinc coating operations were conducted on ultra-low carbon steels, by using the hot dip coating apparatus of FIG. 1. In this Example, the hot dip coating apparatus 1 was equipped with sealing members of the type shown in FIG. 4A. The sealing members had a length of 2400 mm which was greater than the breadth (2000 mm) of the steel strip. Carbon as used as the material of the sealing members.

The conditions of the coating operations were as shown below.

Type of the steel strip coated: Ultra-low carbon steel

Size of steel strip: breadth 1200 mm, thickness 1.0 mm

Strip running speed: 130 mpm

Molten metal composition: Zn+0.2% Al

Molten metal temperature: 475° C.

Strip temperature immediately before coating: 480° C.

Molten metal supply rate: 400 l/min

Level of the molten metal surface inside tank: 200 mm

Amount of deposition: 45 g/m$^2$ on each surface (regulated by $N_2$ gas)

Frequency of A.C. power supplied to magnetic field applying device: 2 KHz

Magnetic flux density between cores of magnetic field applying device: 0.5 T

Running of the steel strip S was commenced at a running velocity of 50 mpm without supplying the molten metal into coating tank 1. Moving devices 5 having pneumatic cylinders were activated to bring the sealing members 4 into contact with both major surfaces of the running steel strip. Then, the electromagnetic sealing device 2 was started to commence the application of the magnetic field. Subsequently, the pump P was started to progressively supply the molten metal from auxiliary tank 13 into coating tank 1, and the rate of supply of the molten metal was set to a predetermined level. Then, the steel strip was accelerated to a predetermined velocity, while the doctoring device 20 was started, whereby steady coating operation was commenced. It was thus possible to start-up the hot-dip coating apparatus without allowing molten metal to leak through slit 3, whereby the components of steel strip supporting device 30 under slit 3 was avoided.

Then, while the steady coating operation was continued, sealing members 4 were brought into contact with both surfaces of the running steel strip. Thereafter, the supply of the molten metal to coating tank 1 was ceased and the gas wiping device serving as the doctoring device 20 was stopped. The molten metal remaining inside coating tank 1 was then returned to auxiliary tank 13 through molten metal supply passage 12. Then, after coating tank 1 became empty, the operation of electromagnetic shield device 2 was turned off and the running of the steel strip was stopped, followed by movement of sealing members 4 away from the steel sheet, thus completing the coating process.

It was thus possible to stably and safely commence and terminate the coating process without allowing contamination of the components of steel strip supporting device 30 under slit 3 which might have been caused by leakage of the molten metal in the transitory periods immediately after the start-up and during termination of the coating operation.

Example 5

Hot dip zinc coating operations were performed on ultra-low carbon steel strips by using the hot dip coating apparatus of FIG. 1 which in this Example was equipped with the sealing members of the type shown in FIG. 4B.

Heat-resistant belts 41 supported by non-powered rollers 42 were arranged so as to be moved into and out of contact with the steel strip S by operation of moving devices 5 incorporating pneumatic cylinders. Belts 41 had a breadth of 2400 mm which was greater than that of slit 3, and kao wool was used as the material of the belt. A scraper serving as molten metal scraping device 43 was associated with each heat-resistant belt 41, so as to scrape molten metal off heat-resistant belt 41. The molten metal thus scraped was collected in a molten metal collecting vessel 37.

The conditions of the coating operation were the same as those in Example 4.

Running of the steel strip S was commenced at a running velocity of 50 mpm without supplying the molten metal into coating tank 1, and heat-resistant belts 41 were moved into contact with both major surfaces of the running steel strip. Then, electromagnetic sealing device 2 was started to commence the application of the magnetic field. Subsequently, pump P was started to progressively supply the molten metal from auxiliary tank 13 into coating tank 1, and the rate of supply of the molten metal was set to a predetermined level. Then, the steel strip was accelerated to a predetermined velocity, while doctoring device 20 was started, whereby steady coating operation was commenced. Molten metal which was transferred to heat-resistant belts 41 so as to attach thereto was scraped off belts 41 by the molten metal scraping device and was collected in molten metal collecting vessel 37. Then, after the leakage of the molten metal through slit 3 terminated, heat-resistant belts 41 were moved away from the steel strip, and steady coating operation commenced.

The coating operation was steadily performed in this state to complete the coating over a predetermined length of the steel strip S. Then, while the steady coating operation was continued, the heat-resistant belts 41 were brought into contact with both surfaces of the running steel strip. Thereafter, the supply of the molten metal to coating tank 1 was stopped and doctoring device 20 was stopped. The molten metal remaining inside coating tank 1 was then returned to auxiliary tank 13 through molten metal drain passage 11. Then, after coating tank 1 became empty, the operation of electromagnetic sealing device 2 was turned off and the running of the steel strip was stopped, followed by movement of heat-resistant belts 41 away from the steel sheet, thus completing the coating process.

By adopting the coating start-up and finishing methods as described, it was possible to stably and safely commence and terminate the coating process without contaminating the components of steel strip supporting device 30 under slit 3 which otherwise might have been caused by leakage of the molten metal in the transitory periods immediately after the start-up and termination of the coating operation.

Example 6

Hot dip zinc coating operations were performed on ultra-low carbon steel strips by using the hot dip coating apparatus of FIG. 1 which in this Example was equipped with the sealing members of the type shown in FIG. 4C.

A gas-jet sealing device 45, capable of applying a jet of gas against the surfaces of the steel strip S so as to blow leaked molten metal off the steel strip S. was situated at a position immediately below the bottom slit 3 of coating tank 1 and above the steel strip supporting device 30. A molten metal collecting vessel 37 was disposed so as to receive the molten metal blown by the gas-jet sealing device. A pair of such a gas-jet sealing devices were situated to oppose both major surfaces of the steel strip S at a distance of 20 mm. The gas flow rate and the gas pressure were set to be 100 $Nm^3$/min and 250 mm Aq, respectively. Nitrogen gas was used as the sealing gas.

The conditions of the coating operation were the same as those in Example 4.

Running of the steel strip S was commenced at a running velocity of 50 mpm without supplying the molten metal into coating tank 1, and the gas-jet sealing devices were started. Then, electromagnetic sealing device 2 was started to commence the application of the magnetic field. Subsequently, pump P was started to progressively supply the molten metal from auxiliary tank 13 into coating tank 1, and the rate of supply of the molten metal was set to a predetermined level. Then, the steel strip was accelerated to a predetermined velocity, while doctoring device 20 was started. Leaked molten metal was blown off the steel strip by the effect of the gas-jet sealing device, and was collected in the molten metal collecting vessel 37. Then, after the leakage of the molten metal through slit 3 terminated, the gas-jet sealing devices were stopped, whereby steady coating operation was commenced.

The coating operation was steadily performed in this state to complete the coating over a predetermined length of the steel strip. Then, while the steady coating operation was continued, the gas-jet sealing devices 45 were started again and the supply of the molten metal to coating tank 1 was terminated. Thereafter, doctoring device 20 was stopped, and the molten metal remaining inside coating tank 1 was returned to auxiliary tank 13 through molten metal supply passage 12. Then, after coating tank 1 became empty, the operation of electromagnetic sealing device 2 was turned off and the running of steel strip S was stopped, followed by stopping of gas-jet sealing devices 45, thus completing the coating process.

By adopting the coating start-up and finishing methods as described, it was possible to stably and safely commence and terminate the coating process without allowing contamination of the components of steel strip supporting device 30 under slit 3 which otherwise might have been caused by leakage of the molten metal in the transitory periods immediately after the start-up and termination of the coating operation.

Example 7

Hot dip zinc coating operations were performed on ultra-low carbon steel strips by means of the hot dip coating apparatus shown in FIG. 6.

Although not shown in FIG. 6, steel strip S had been subjected to an ordinary pre-treatment: namely, it had been cleaned and annealed. The pre-treated steel strip was then made to run through the steel strip supporting device 30 having the deflector roller, support rollers and the guide rollers to deflect the running strip in a vertical direction and to eliminate any warp of the strip, and was introduced into coating tank 1 to be coated. The steel strip thus coated was then subjected to regulation of the amount of deposition of the coating metal by a gas wiping device serving as the doctoring device 20, followed by cooling. Coating tank 1 was provided with slit 3 having a breadth of 2000 mm. Sealing members 4 were arranged immediately above slit 3. Each sealing member 4 had a cylindrical form having a diameter of 30 mm and an axial length of 2200 mm, and was made of a Zn-0.2% Al alloy. Each sealing member 4 was disposed between projected portion 8 of coating tank 1 and steel strip S. and was fixed at its both ends to coating tank 1 so as not to be pulled and moved by the running steel strip. The conditions of the coating operations were as shown below.

Type of the steel strip coated: Ultra-low carbon steel

Size of steel strip: breadth 1200 mm, thickness 1.0 mm

Strip running speed: 130 mpm

Molten metal composition: Zn 0.2% Al

Molten metal temperature: 475° C.

Strip temperature immediately before coating: 480° C.

Molten metal supply rate: 400 l/min

Level of the molten metal surface inside tank: 200 mm

Amount of deposition: 45 g/m$^2$ on each surface (regulated by $N_2$ gas)

Frequency of A.C. power supplied to magnetic field applying device: 2 KHz

Magnetic flux density between cores of magnetic field applying device: 0.5 T

The coating operation was commenced under these conditions.

As the first step, the steel strip was made to run at a velocity of 30 mpm, while the supply of the molten metal to coating tank has not yet been started. Subsequently, magnetic field applying device 2 was started to generate the magnetic field, followed by the starting of pump P so as to supply the molten metal from auxiliary tank 13 into coating tank 1. The rate of supply of the molten metal was then controlled to a predetermined level. Then, after the gas wiping device was started, the steel strip was accelerated to a predetermined velocity, whereby a steady coating operation was commenced.

As a result of the described coating start-up operation, the coating could be commenced stably and safely, without suffering from any leakage of the molten metal through slit 3.

Although the invention has been described through its preferred forms, it is to be understood that various changes and modifications may be imparted thereto without departing from the scope of the present invention which is limited solely by the appended claims.

What is claimed is:

1. A hot dip coating method for coating a steel strip, in which the steel strip is introduced into a coating tank through a bottom slit formed in the bottom of said coating tank and pulled upward so as to run through said coating tank, and in which a molten metal is supplied from an auxiliary tank to a lower portion of said coating tank through a molten metal supply passage and drained from an upper portion of said coating tank to said auxiliary tank through a molten metal drain passage so as to be circulated through said coating tank, said molten metal being held in said coating tank by the effect of a magnetic field applied thereto by means of a plurality of magnetic field applying means arranged at both sides of the steel strip at a predetermined spacing from each other, so that the steel strip is coated with said molten metal while it runs upward through said coating tank, said method comprising the steps of:

allowing said molten metal to overflow the upper end of said coating tank so as to be drained from said coating tank; and supplying said molten metal into said coating tank through a flow restricting buffer provided in communication with said molten metal supply passage, such that said molten metal is supplied through said buffer towards the steel strip with a uniform flow velocity of the molten metal across the breadth of the steel strip.

2. A hot dip coating method according to claim 1, wherein said coating tank has a split structure composed of a plurality of tank sections, each said tank section and the associated magnetic field applying means being arranged for movement towards and away from the steel strip, said method further comprising the steps of:

conducting on-line measurement of the profile of the steel strip at a location upstream of said bottom slit of said coating tank;

stopping the supply of said molten metal when the value measured in said on-line measurement has exceeded a predetermined limit value;

draining said molten metal from said coating tank after the stopping of the supply of said molten metal; and moving, after the draining of said molten metal, said tank sections away from the steel strip together with or without being accompanied by said magnetic field applying means.

3. A hot dip coating method according to claim 1, further comprising the steps of:

providing in said coating tank a molten metal discharge passage in communication with said buffer; and causing said molten metal to be discharged from said molten metal discharge passage towards the steel strip.

4. A hot dip coating method according to claim 1, wherein the rate of circulation of said molten metal between said coating tank and said auxiliary tank is 100 l/min or greater.

5. A hot dip coating method according to claim 1, wherein the temperature of said molten metal in said molten metal supply passage is controlled to be not lower than the temperature of said molten metal in said auxiliary tank.

6. A hot dip coating method for coating a steel strip, in which the steel strip is introduced into a coating tank through a bottom slit of said coating tank and pulled upward so as to run through said coating tank, and in which a molten metal is supplied to a lower portion of said coating tank through a molten metal supply passage and drained from an upper portion of said coating tank to circulate the molten metal through said coating tank, said molten metal being held in said coating tank a magnetic field applied thereto by means of a plurality of magnetic field applying means arranged at both sides of the steel strip at a predetermined spacing from each other, so that the steel strip is coated with said molten metal while it runs upward through said coating tank, said method comprising the steps of:

allowing said molten metal to overflow the upper end of said coating tank so as to be drained from said coating tank;

supplying said molten metal into said coating tank through a buffer provided in communication with said molten metal supply passage, such that said molten metal is supplied through said buffer towards the steel strip, wherein the coating operation is started through the steps of:

causing the steel strip to run at a predetermined velocity without starting the supply of said molten metal into said coating tank, while moving a pair of sealing members into contact with or to positions in the close proximity of the steel strip at a location immediately below said bottom slit of said coating tank and/or blowing a gas onto the steel strip at said location;

applying the magnetic field to said coating tank; and commencing the supply of said molten metal into said coating tank, thereby starting up the coating operation.

7. A hot dip coating method for coating a steel strip, in which the steel strip is introduced into a coating tank through a bottom slit of said coating tank and pulled upward so as to run through said coating tank, and in which a molten metal is supplied to a lower portion of said coating tank through a molten metal supply passage and drained from an upper portion of said coating tank to circulate the molten metal through said coating tank, said molten metal being held in said coating tank a magnetic field applied thereto by means of a plurality of magnetic field applying means arranged at both sides of the steel strip at a predetermined spacing from each other, so that the steel strip is coated with said molten metal while it runs upward through said coating tank, said method comprising the steps of:

allowing said molten metal to overflow the upper end of said coating tank so as to be drained from said coating tank;

supplying said molten metal into said coating tank through a buffer provided in communication with said molten metal supply passage, such that said molten metal is supplied through said buffer towards the steel strip, wherein the coating operation is terminated through the steps of:

stopping the supply of said molten metal into said coating tank, while moving a pair of sealing members into contact with or to positions in the close proximity of the steel strip at a location immediately below said bottom slit of said coating tank and/or blowing a gas onto the steel strip at said location;

evacuating said coating tank by causing the molten metal remaining in said coating tank to attach to and be conveyed by the running steel strip or by shifting the molten metal into an auxiliary tank; and ceasing the application of the magnetic field, thereby terminating the coating operation.

8. A hot dip coating method for coating a steel strip, in which the steel strip is introduced into a coating tank through a bottom slit of said coating tank and pulled upward so as to run through said coating tank, and in which a molten metal is supplied to a lower portion of said coating tank through a molten metal supply passage and drained from an upper portion of said coating tank to circulate the molten metal through said coating tank, said molten metal being held in said coating tank a magnetic field applied thereto by means of a plurality of magnetic field applying means arranged at both sides of the steel strip at a predetermined spacing from each other, so that the steel strip is coated with said molten metal while it runs upward through said coating tank, said method comprising the steps of:

allowing said molten metal to overflow the upper end of said coating tank so as to be drained from said coating tank;

supplying said molten metal into said coating tank through a buffer provided in communication with said molten metal supply passage, such that said molten metal is supplied through said buffer towards the steel strip, wherein the coating operation is started through the steps of:

disposing, at a location within or immediately above said bottom slit of said coating tank, sealing members made of a material meltable at a temperature not higher than the melting temperature of the coating metal, so as to block said bottom slit of said coating tank, while the supply of the molten metal into said coating tank has not yet been commenced;

causing the steel strip to run through said bottom slit, past said sealing members;

commencing the supply of the molten metal into said coating tank; and commencing application of the magnetic field to said coating tank, thereby starting up the coating operation.

9. In a hot dip coating method in which a steel strip is coated as it is fed upwardly through a slit in a bottom of a coating tank, in which molten metal for coating the strip is circulated through the coating tank via inlets on opposite sides of the slit near the bottom of the coating tank and an outlet at a top of the coating tank, and in which a magnetic field prevents the molten metal from leaking through the slit, the improvement comprising the step of:

making a flow velocity of the molten metal uniform across a breadth of the strip by directing the molten metal through a flow restricting buffer as the molten metal enters the coating tank at the inlets.

* * * * *